US007805092B2

(12) United States Patent
Mihara

(10) Patent No.: US 7,805,092 B2
(45) Date of Patent: Sep. 28, 2010

(54) TONER CONTAINER, TONER FEED DEVICE AND IMAGE FORMING APPARATUS

(75) Inventor: Koichi Mihara, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 678 days.

(21) Appl. No.: 11/806,730

(22) Filed: Jun. 4, 2007

(65) Prior Publication Data

US 2008/0013984 A1 Jan. 17, 2008

(30) Foreign Application Priority Data

Jul. 13, 2006 (JP) ..... 2006-193258

(51) Int. Cl.
*G03G 15/08* (2006.01)

(52) U.S. Cl. ..... 399/106; 399/120; 399/258; 399/260; 399/262

(58) Field of Classification Search ..... 399/106, 399/120, 258, 260, 262
See application file for complete search history.

(56) References Cited

U.S. PATENT DOCUMENTS

| | | | | |
|---|---|---|---|---|
| 7,010,250 | B1 * | 3/2006 | Yahagi | 399/258 |
| 2005/0058471 | A1 * | 3/2005 | Nagahama et al. | 399/262 |
| 2005/0123323 | A1 * | 6/2005 | Koyama et al. | 399/258 |
| 2006/0008298 | A1 * | 1/2006 | Koyama | 399/258 |
| 2006/0147228 | A1 | 7/2006 | Nagahama et al. | |
| 2006/0165441 | A1 * | 7/2006 | Deguchi | 399/258 |
| 2007/0248384 | A1 * | 10/2007 | Kawai | 399/260 |
| 2008/0013983 | A1 * | 1/2008 | Mihara | 399/258 |

FOREIGN PATENT DOCUMENTS

| | | | |
|---|---|---|---|
| JP | 2002-139903 | A | 5/2002 |
| JP | 2003-5501 | A | 1/2003 |
| JP | 2004-258472 | A | 9/2004 |
| JP | 2004-333854 | | 11/2004 |
| JP | 2005-31356 | A | 2/2005 |
| JP | 2005-107141 | | 4/2005 |
| JP | 2005-107141 | A | 4/2005 |

* cited by examiner

*Primary Examiner*—Ryan D Walsh
(74) *Attorney, Agent, or Firm*—Nixon & Vanderhye, PC

(57) ABSTRACT

A toner container that is removably attached to a toner feed device for feeding toner to a developing unit provided for an image forming apparatus, includes: a container body filled with toner; and a supporting structure, which supports the container body in a rotatable manner by enclosing the outer peripheral surface along the rotational direction of the container body so as to include the area where a toner feed recess is formed, and has a toner feed aperture for feeding the toner discharged from a toner discharge aperture of the container body into the toner feed recess, to the outside. The supporting structure includes a shutter opening and closing mechanism having a shutter element that is movable along a fixed direction to open and close the toner feed aperture. This shutter opening and closing mechanism in the supporting structure is formed with an anti-slide portion for restraining the movement of the shutter element before the toner container is mounted to the toner feed device.

3 Claims, 20 Drawing Sheets

TONER CONTAINER, TONER FEED DEVICE AND IMAGE FORMING APPARATUS

This Nonprovisional application claims priority under 35 U.S.C. §119 (a) on Patent Application No. 2006-193258 filed in Japan on 13 Jul. 2006, the entire contents of which are hereby incorporated by reference.

BACKGROUND OF THE TECHNOLOGY

1. Field of the Technology

The technology relates to a toner container for storing toner used for an image forming apparatus such as a copier, printer, facsimile machine and the like as well as to a toner feed device to which the toner container is detachably mounted and an image forming apparatus equipped with the toner feed device. The technology particularly relates a shutter opening and closing mechanism as an opening and closing means provided for toner feed aperture in the toner container.

2. Description of the Prior Art

In general, in an image forming apparatus such as a copier, printer, facsimile machine and a multifunctional machine at least including two functions of these, its output is produced by forming an electrostatic latent image on a photoreceptor, developing the electrostatic image on the photoreceptor with a developer that is fed from a developing unit to the photoreceptor to form a developer image on the photoreceptor, transferring the developer image from the photoreceptor to recording paper and heating and pressing the recording paper to fix the developer image to the recording paper.

In the developing unit, for example a dual component developer composed of a mixture of a toner and a magnetic carrier is agitated so as to tribo-electrify the toner, and the thus agitated dual-component developer is caused to adhere to the surface of a rotating developing roller so as to convey and supply the dual-component developer to the development area between the developing roller and photoreceptor, to thereby develop the electrostatic latent image on the photoreceptor with the toner from the dual-component developer. The developer roller is composed of a cylindrical sleeve and magnets arranged inside the sleeve. The developer roller, as it is rotating its sleeve and attracting the dual-component developer to the sleeve surface by the magnetic field from the magnets in the sleeve, conveys and supplies the dual-component developer from the sleeve to the photoreceptor.

Further, since, in the developing unit, toner is consumed from the dual-component developer as electrostatic latent images on the photoreceptor are developed, toner has to be successively supplied by means of a toner feed device as the developer is consumed. This toner feed device includes an intermediate hopper (toner supply hopper) for temporarily storing the toner to be fed to the developing unit and supplying the necessary amount of toner to the developing unit and a toner container that stores toner and is mounted to the intermediate hopper. Provided in the portion where the toner container is mounted to the intermediate hopper is a mounting mechanism for allowing the toner container to be removably mounted to the intermediate hopper. This mounting mechanism is formed with a feed path for connecting the toner feed aperture of the toner container with the intermediate hopper. In this way, toner is supplied from the toner feed device including a toner container such as a toner cartridge, toner bottle or the like, to the developing unit, and when almost all the toner in the toner container is used up, the toner container is replaced with a new one as appropriate by the user.

One configuration of such a toner container is disclosed in, for example, Japanese Patent Application Laid-open 2004-333854 (patent document 1). This toner container is constructed such that its container body has projected pieces formed at its one end face with respect to the axial direction thereof, and is mounted to an image forming apparatus with the projected pieces engaged with a main-body side coupler so that a rotational drive force about the axis can be transferred to the container body. The container body also has a refill port for charging the developer, formed at the same end face with respect to the axial direction and covered with a removable cap member so that the cap member is covered by the main body-side coupler when the projected pieces are coupled with the main body-side coupler. This toner container has a toner discharge aperture at the approximate center of the container body, and the approximately central portion of the container body including the portion where the toner discharge aperture is formed is supported by an approximately cylindrical supporting structure. This supporting structure has a toner feed aperture formed at the position corresponding to the toner discharge aperture of the container body. This toner feed aperture is provided with a shutter opening and closing mechanism which can open and close the opening in the lengthwise direction of the toner container.

However, since the shutter opening and closing mechanism provided for the toner container disclosed in the aforementioned patent document 1 has a structure which can be simply opened and closed by sliding the toner container in its length direction. As a result, the shutter element of the shutter opening and closing mechanism might be erroneously moved by an unexpected load or the like during replacement or transportation of the toner container. That is, this configuration entails the risk that the shutter element of the shutter opening and closing mechanism opens before the toner container is mounted to the toner feed device and the user's hands and clothes are dirtied by leakage and scatter of toner from the toner container.

SUMMARY OF THE TECHNOLOGY

The technology has been devised in view of the above problem entailed with the conventional toner container and toner feed device, it is therefore an object of the technology to provide a new and improved toner container whose shutter opening and closing mechanism opens its shutter element only after the toner container has been mounted to the intermediate hopper of a toner feed device, as well as to provide a toner feed device and image forming apparatus to which the toner container is applied.

In order to achieve the above object, one aspect of the present technology provides a toner container that is removably attached to a toner feed device for feeding toner to a developing unit provided for an image forming apparatus, comprising: a container body including a toner storing portion filled with toner, and a toner discharge aperture arranged in a toner feed recess formed on the outer peripheral surface of the toner storing portion for discharging toner from the toner storing portion by rotationally driving the toner storing portion about the axis thereof as a rotary axis; and a supporting structure, which supports the container body in a rotatable manner by enclosing the outer peripheral surface along the rotational direction of the container body so as to include the area where the toner feed recess is formed, and has a toner feed aperture for feeding the toner discharged from the toner discharge aperture into the toner feed recess, to the outside, characterized in that the supporting structure includes a shutter opening and closing mechanism having an approximately plate-like shutter element that is movable along a fixed direction to open and close the toner feed aperture; and, the shutter opening and closing mechanism in the supporting structure is formed with an anti-slide portion for restraining the movement of the shutter element before the toner container is mounted to the toner feed device.

With this configuration, it is possible for the anti-slide portion to prevent the shutter element of the shutter opening and closing mechanism provided for the toner feed aperture from being erroneously opened by unexpected load or the like before the toner container is mounted to the toner feed device.

The above mode of embodiment may also be constructed such that the shutter opening and closing mechanism, opens the toner feed aperture by releasing the constraint on the movement of the shutter element by the anti-slide portion in linkage with the mounting operation when the toner container is mounted to the toner feed device, and closes the toner feed aperture by moving the shutter element in linkage with the dismounting operation when the toner container is dismounted from the toner feed device.

With this arrangement, it is possible to provide the opening and closing function of the shutter opening and closing mechanism for toner feed aperture with an integrated part configuration. As a result it is to secure the opening and closing function of the shutter opening and closing mechanism with a simple manner and in addition, improve the reliability of the opening and closing function of the shutter opening and closing mechanism.

Further, the above mode of embodiment may be constructed such that an erected portion that stands upright to the surface where the shutter opening and closing mechanism is mounted in the supporting structure is formed between the outer part of the supporting structure and the anti-slide portion.

With this configuration, it is possible to prevent the third person from inserting their hands, fingers etc., into the shutter opening and closing mechanism and operating the anti-slide portion and plate-like member after the toner container is mounted to the toner feed device. Accordingly, the reliability of the opening and closing function of the shutter opening and closing mechanism can be improved.

Also, the above mode of embodiment may be constructed such that the container body is applied with a sealing element for sealing the toner discharge aperture; and the sealing element is engaged with the supporting structure at one end opposite to the other end thereof which seals the toner discharge aperture when the container body is held by the supporting structure.

With the above configuration, the container body of the toner container can be fixed to the supporting structure, so that it is possible to prevent the toner container from being rotated by unexpected load or the like during shipment of toner feed device or any other occasion.

Another aspect of the present technology in order to solve the above problem provides a toner feed device comprising: a toner container filled with toner; and an intermediate hopper which has the toner container attached thereto, temporarily stores the toner discharged from the toner container and supplies the toner to a developing unit provided for an image forming apparatus, wherein one of the toner containers according to the above-described modes of embodiment is used as its toner container.

With this configuration, the shutter opening and closing mechanism provided for the toner feed aperture of the toner container can be locked by the anti-slide portion, so that this arrangement facilitates the mounting of the toner container to toner feed device without causing toner leakage, thus contributing to improvement in workability and maintenance performance.

As described heretofore, it is possible for the anti-slide portion provided for the toner container to prevent the shutter element of the shutter opening and closing mechanism provided for the toner feed aperture from being erroneously opened before the toner container is mounted to the toner feed device. Accordingly, this configuration facilitates the user to handle the toner container without causing toner leakage when the user handles the toner container alone such as during hand carriage. As a result, improvement in workability and maintenance performance can be expected without dirtying the user, image forming apparatus etc., with toner spilling out of the toner container.

DESCRIPTION OF THE PREFERRED EMBODIMENTS

Figure 1:
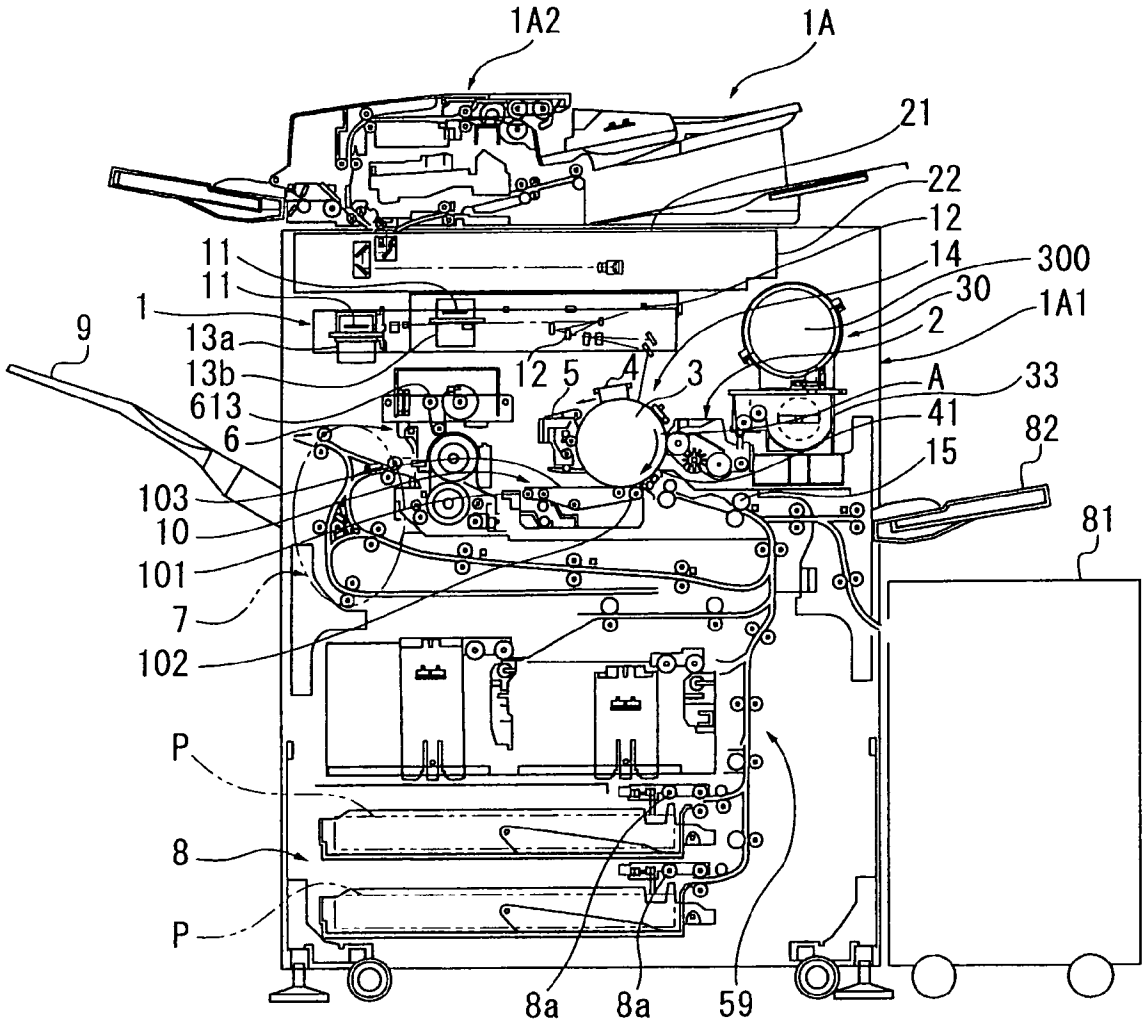
FIG. 1 is an illustrative view showing an overall configuration of the first embodiment of an image forming apparatus in which a toner container according to the present embodiment is used.

A preferred embodiment will hereinafter be described in detail with reference to the accompanying drawings. Here in this specification and drawings, the components having essentially the same functions are allotted with the same reference numerals so that repeated description will be omitted.

The First Embodiment

Figure 2:
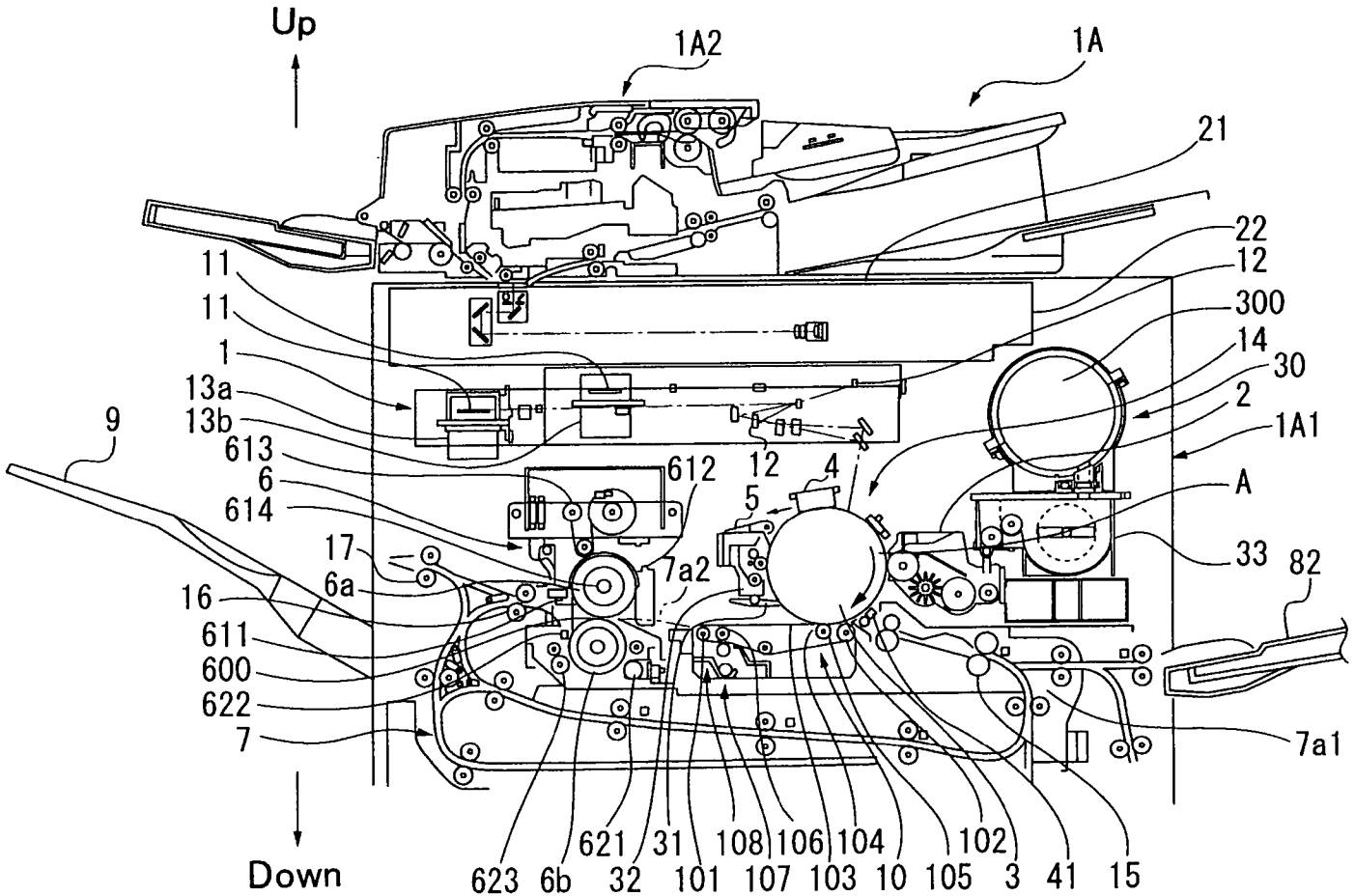
FIG. 2 is a partial detailed view showing the configuration of the apparatus body of the image forming apparatus in the same embodiment.

To being with, the configuration of the first embodiment of an image forming apparatus in which a toner container is used will be described with reference to the drawings. FIG. 1 is an illustrative view showing an overall configuration of the first embodiment of an image forming apparatus in which a toner container is used, and FIG. 2 is a partial detailed view showing the configuration of the apparatus body of the same image forming apparatus.

An image forming apparatus 1A in which a toner container according to the present embodiment is used is an image forming apparatus that forms and outputs a monochrome image of image data that was captured by a scanner or the like or image data that was transferred from without, on a predetermined sheet of recording material (to be referred to hereinbelow as paper) as a recording medium, by electrophotography. This image forming apparatus 1A includes a paper feed tray 8 which can stack multiple sheets of paper P thereon; a paper conveying portion 59 for conveying paper P fed from this paper feed tray 8 to an image forming portion 14; and a paper conveyor system 7 for conveying the paper P with an unfixed toner image printed thereon by image forming portion 14 to a fixing unit 6 where the unfixed toner is fused and fixed onto the paper. The image forming apparatus, based on the conveying speeds of paper P corresponding to a multiple number of preset printout processing modes, can select and control the conveying speed of paper P in accordance with a print request and automatically feed paper P from paper feed tray 8 to a paper output tray 9.

Image forming apparatus 1A is essentially composed of, as shown in FIG. 1, an apparatus body 1A1 including a light exposure unit 1, a developing unit 2, a toner feed device 30, a photoreceptor drum 3, a charger 4, a charge erasing device 41, a cleaner unit 5, a fixing unit 6, paper conveyor system 7, a paper feed paths 7*a*, paper feed tray 8, paper output tray 9, a transfer device 10 and the like, and an automatic document processor 1A2.

Formed on the top surface of apparatus body 1A1 is an original placement table 21 made of transparent glass on which a document is placed. Automatic document processor 1A2 is arranged on top of this original placement table 21 so that it can pivotally open upwards while a scanner portion 22 as a document reader for reading image information of originals is laid out under this original placement table 21.

Arranged below scanner portion 22 are light exposure unit 1, developing unit 2, photoreceptor drum 3, charger 4, charge erasing device 41, cleaner unit 5, fixing unit 6, paper conveyor system 7, paper feed paths 7*a*, paper output tray 9 and transfer device 10. Further, paper feed tray 8 that accommodates paper P is arranged under these.

Light exposure unit 1 provides a function of emitting a laser beam in accordance with the image data output from an unillustrated image processor to irradiate the photoreceptor drum 3 surface that has been uniformly charged by charger 4 so as to write and form an electrostatic latent image corresponding to the image data on the photoreceptor drum 3 surface. This light exposure unit 1 is arranged directly under scanner portion 22 and above photoreceptor drum 3, and includes laser scanning units (LSUs) 13*a* and 13*b* each having a laser emitter 11 and a reflection mirror 12. In the present embodiment, in order to achieve high-speed printing operation, a method for alleviating a rush of irradiation timings by using a multiple number of laser beams, namely a two-beam method, is adopted. Here, in the present embodiment laser scanning units (LSUs) 13*a* and 13*b* are used for light exposure unit 1, but an array of light emitting elements, e.g., an EL or LED writing head may also be used.

Photoreceptor drum 3 has an approximately cylindrical shape, is arranged under light exposure unit 1 and is controlled so as to rotate in a predetermined direction (in the direction of arrow A in the drawing) by an unillustrated drive means and control means. Arranged starting from the position at which image transfer ends downstream in the rotational direction of the photoreceptor drum along the peripheral surface of this photoreceptor drum 3 are, as shown in FIG. 2, a paper separation claw 31, cleaner unit 5, charger 4 as an electric field generator, developing unit 2 and charge erasing device 41 in the order mentioned.

Paper separation claw 31 is disposed so as to be moved into and out of contact with the outer peripheral surface of photoreceptor drum 3 by means of a solenoid 32. When this paper separation claw 31 is put in abutment with the outer peripheral surface of photoreceptor drum 3, it functions to peel off the paper P that has adhered to the photoreceptor drum 3 surface during the unfixed toner image on photoreceptor drum 3 being transferred to the paper. Here, as an actuating means for paper separation claw 31, an actuating motor or the like may be used instead of solenoid 32, or any other actuating means may be also selected.

Developing unit 2 visualizes the electrostatic latent image formed on photoreceptor drum 3 with black toner, and is arranged at approximately the same level at the side (on the right side in the drawing) of photoreceptor drum 3 downstream of charger 4 with respect to the rotational direction of the photoreceptor drum (in the direction of arrow A in the drawing). A registration roller 15 is disposed under this developing unit 2 on the upstream side with respect to the recording medium feed direction.

Toner feed device 30 temporarily holds the toner discharged from a toner container 300 filled with toner, in an intermediate hopper 33 and then supplies it to developing unit 2. This toner feed device is arranged adjacent to developing unit 2. Details of toner feed device 30 will be described later.

Registration roller 15 is operated and controlled by an unillustrated drive means and control means so as to convey the paper P delivered from paper feed tray 8 into and between photoreceptor drum 3 and a transfer belt 103 whilst making the leading end of the paper P register with the toner image on the photoreceptor drum 3.

Charger 4 is a charging means for uniformly charging the photoreceptor drum 3 surface at a predetermined potential, and is arranged over photoreceptor drum 3 and close to the outer peripheral surface thereof. Here, a discharge type charger 4 is used in the present embodiment, but a contact roller type or a brush type may be used instead.

Charge erasing device 41 is a pre-transfer erasing means for lowering the surface potential of the photoreceptor drum 3 in order to facilitate the toner image formed on the photoreceptor drum 3 surface to transfer to paper P, and is laid out on the downstream side of developing unit 2 with respect to the photoreceptor drum's direction of rotation and under photoreceptor drum 3 and close to the outer peripheral surface of the same. Though in the present embodiment, charge erasing device 41 is configured using a charge erasing electrode, a charge erasing lamp or any other method can be used for charge removal instead of the charge erasing electrode.

Cleaner unit 5 removes and collects the toner left on the surface of photoreceptor drum 3 after development and image transfer, and is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper P being conveyed as transfer device 10 applies an electric field having an opposite polarity to that of the electric charge of the electrostatic image. For example, when the electrostatic image bears negative (−) charge, the applied polarity of transfer device 10 should be positive (+).

Transfer device 10 is provided in the form of a transfer belt unit in which a transfer belt 103 having a predetermined resistivity (ranging from $1\times10^{9}$ to $1\times10^{13}\Omega\cdot$cm in the embodiment) is wound and tensioned on a drive roller 101, a driven roller 102 and other rollers, and is disposed under photoreceptor drum 3 with the transfer belt 103 surface put in contact with part of the outer peripheral surface of photoreceptor drum 3. This transfer belt 103 conveys paper P while pressing the paper against photoreceptor drum 3. An elastic conductive roller 105 having a conductivity different from that of drive roller 101 and driven roller 102 and capable of applying a transfer electric field is laid out at a contact point 104 (FIG. 2) where transfer belt 103 comes into contact with photoreceptor drum 3.

Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper P being conveyed.

Further, a charge erasing roller 106 (FIG. 2) for erasing the electric field that has been applied to the paper P being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

As shown in FIG. 2, transfer device 10 also includes a cleaning unit 107 for removing dirt due to leftover toner on transfer belt 103 and a plurality of charge erasing devices 108 for erasing electricity on transfer belt 103. Erasure of charge by erasing devices 108 may be performed by grounding via the apparatus or by actively applying charge of a polarity opposite to that of the transfer field.

The paper P with the static image (unfixed toner) transferred thereon by transfer device 10 is conveyed to fixing unit 6, where it is pressed and heated so as to fuse the unfixed toner and fix it to the paper P. Fixing unit 6 includes a heat roller **6*a* and a pressing roller 6*b* as shown in FIG. 2 and fuses and fixes the toner image transferred on paper P by rotating heat roller 6*a* so as to convey the paper held between heat roller 6*a* and pressing roller 6*b* through the nip between heat roller 6*a* and pressing roller 6*b*. Arranged on the downstream side of fixing unit 6 with respect to the direction of paper conveyance is a conveyance roller 16** for conveying paper P.

Heat roller **6*a* has a sheet separation claw 611, a thermistor 612 as a roller surface temperature detector and a roller surface cleaning member 613, all arranged on the outer periphery thereof and a heat source 614 for heating the heat roller surface at a predetermined temperature (set fixing temperature: approximately 160 to 200 deg. C.) provided in the interior part thereof. Heat roller 6*b* is provided at each end with a pressing element 621 capable of abutting the pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a***.

In this fixing unit 6, as shown in FIG. 2 the unfixed toner on the paper P being conveyed is heated and fused by heat roller **6*a*, at the pressed contact (so-called fixing nip portion) 600 between heat roller 6*a* and pressing roller 6*b*, so that the unfixed toner is fixed to the paper P by its anchoring effect by the pressing force from heat roller 6*a* and pressing roller 6*b***.

Paper feed tray 8 (FIG. 1) stacks a plurality of sheets (paper) to which image information will be output (printed), and is arranged under image forming portion 14 made up of light exposure unit 1, developing unit 2, photoreceptor drum 3, charger 4, charge erasing device 41, cleaner unit 5, fixing unit 6 etc. A paper pickup roller **8*a* is disposed at an upper part on the paper delivery side of this paper feed tray 8**.

This paper pickup roller **8*a* picks up paper P, sheet by sheet, from the topmost of a stack of paper stored in paper feed tray 8, and conveys the paper downstream (for convenience' sake, the delivery side of paper P (the cassette side) is referred to as upstream and the paper output side is referred to as downstream) to the registration roller (also called "idle roller") 15 side in the paper feed path 7***a*.

Since the image forming apparatus 1A according to the present embodiment is aimed at performing high-speed printing operations, a multiple number of paper feed trays 8 each capable of stacking 500 to 1500 sheets of standard-sized paper P are arranged under image forming portion 14. Further, a large-capacity paper feed cassette 81 capable of storing multiple kinds of paper in large volumes is arranged at the side of the apparatus while a manual feed tray 82 essentially for supporting printing of irregular sized paper etc. is arranged on the top of the large-capacity paper feed cassette 81.

Paper output tray 9 is arranged on the opposite side across the apparatus from that of manual feed tray 82. It is also possible to configure such a system that instead of paper output tray 9, a post-processing machine for stapling, punching of output paper and other processes and/or a multi-bin paper output tray etc., may be arranged as an option.

Paper conveyor system 7 is laid out between the aforementioned photoreceptor drum 3 and paper feed tray 8, and conveys paper P supplied from paper feed tray 8, sheet by sheet, by way of paper feed paths 7*a* provided for paper conveyor system 7, to transfer device 10, where a toner image is transferred from photoreceptor drum 3 to the paper, further conveying it to fixing unit 6 where the unfixed toner image is fixed to the paper, then conveys the sheet as it is being guided by paper feed paths and branch guides, in accordance with the designated paper output processing mode.

In the image forming apparatus 1A according to the present embodiment, two predetermined paper output processing modes, namely, one-sided printing mode and two-sided printing mode are prepared. In one-sided printing mode, there are two ways of paper output, i.e., the faceup output by which the paper is discharged with its printed surface faceup and the facedown output by which the paper is discharged with its printed surface facedown.

Figure 3:
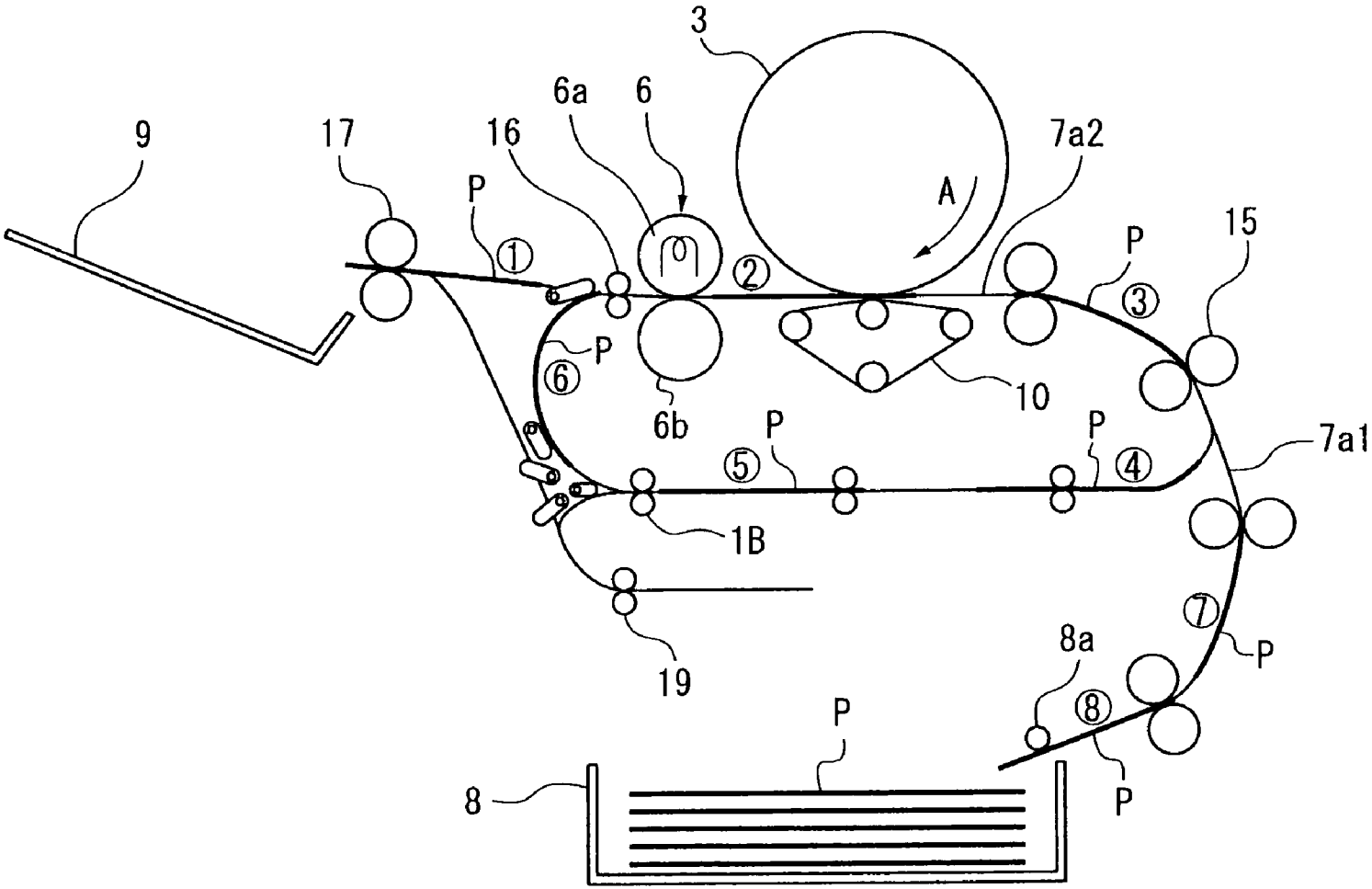
FIG. 3 is an illustrative view showing the configuration of paper feed paths in the image forming apparatus according to the same embodiment.

Now, paper feed paths 7*a* provided for paper conveyor system 7 will be described in detail with reference to the drawings. FIG. 3 is an illustrative view showing the configuration of paper feed paths in the image forming apparatus according to the present embodiment; and FIG. 4 is a partial detailed view showing the configuration of branched paper feed paths for the paper feed paths and branch guides for connection therebetween.

Figure 4:
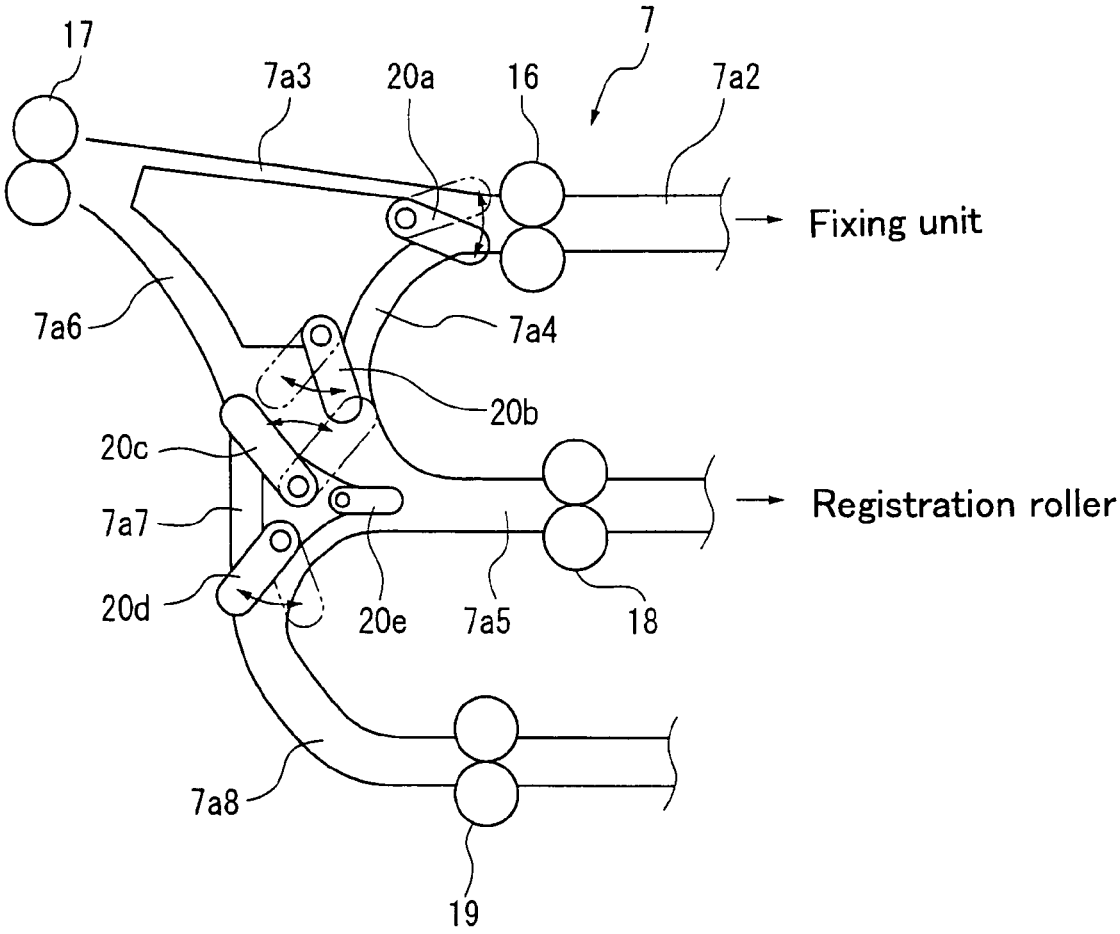
FIG. 4 is a partial detailed view showing the configuration of branched paper feed paths for the paper feed paths and branch guides for connection therebetween shown in FIG. 3.

As shown in FIGS. 3 and 4, paper conveyor system 7 is essentially composed of a first paper feed path 7*a*1 extending from paper feed tray 8 to registration roller 15, a second paper feed path 7*a*2 extending from registration roller 15 and passing through transfer device 10 and fixing unit 6 to a conveyance roller 16 on the downstream side, a third paper feed path 7*a*3 extending from conveyance roller 16 to a paper discharge roller 17 for discharging paper to paper output tray 9, a fourth paper feed path 7*a*4 for inverting paper P from conveyance roller 16, a fifth paper feed path 7*a*5 connected to fourth paper feed path 7*a*4 and extending to an inversion conveyance roller 18 for re-feeding paper P to registration roller 15, a sixth paper feed path 7*a*6 for conveying paper P in reverse from paper discharge roller 17, a seventh paper feed path 7*a*7 connected to the sixth paper feed path and avoiding entrance to fifth paper feed path 7*a*5 and an eighth paper feed path 7*a*8 connected to seventh paper feed path 7*a*7 and extending to a switchback roller 19.

Here, paper feed paths 7*a* can be occupied inside by a multiple number of paper P depending on the processing mode. In the present embodiment, eight sheets of paper P may be present at locations (1) to (8) (represented by encircled numerals in the drawing) in paper feed paths 7*a*, as shown in FIG. 3. The number of paper P permissible to be present in the paper feed paths can be varied depending on the paper feed path configuration. Further, a plurality of branch guides for switching the route of paper P's conveyance by selecting the paper feed path in accordance with the selected processing mode are arranged at branch points of paper feed paths.

As shown in FIG. 4, a branch guide 20*a* that selects connection to third paper feed path 7*a*3 or fourth paper feed path 7*a*4 is pivotably arranged at a point downstream of conveyance roller 16. This branch guide 20*a* is operated by an unillustrated solenoid.

A branch guide 20*b* that connects fourth paper feed path 7*a*4 with fifth paper feed path 7*a*5 or fifth paper feed path 7*a*5 with sixth paper feed path 7*a*6 is pivotably arranged on the downstream side of fourth paper feed path 7*a*4. This branch guide 20*b* is operated by the elastic force of an unillustrated spring member and the rigidity of paper P.

A branch guide 20*c* that selects connection to fifth paper feed path 7*a*5 or seventh paper feed path 7*a*7 is pivotably arranged on the downstream side of sixth paper feed path 7*a*6. This branch guide 20*c* is adapted to operate by an unillustrated solenoid.

A branch guide 20*d* that connects seventh paper feed path 7*a*7 with eighth paper feed path 7*a*8 or fifth paper feed path 7*a*5 with eighth paper feed path 7*a*8 is pivotably arranged on the downstream side of seventh paper feed path 7*a*7. This branch guide 20*d* is adapted to operate by an unillustrated solenoid.

A branch guide 20*e* for assuring smooth connection from fourth paper feed path 7*a*4 or eighth paper feed path 7*a*8 to fifth paper feed path 7*a*5 is pivotably arranged on the upstream side of fifth paper feed path 7*a*5.

With the thus configured paper conveyor system 7, branch guides 20*a* to 20*d* are operated in accordance with the requested processing mode, whereby it is possible to select a conveyance route of paper P corresponding to the processing mode.

Figure 5:
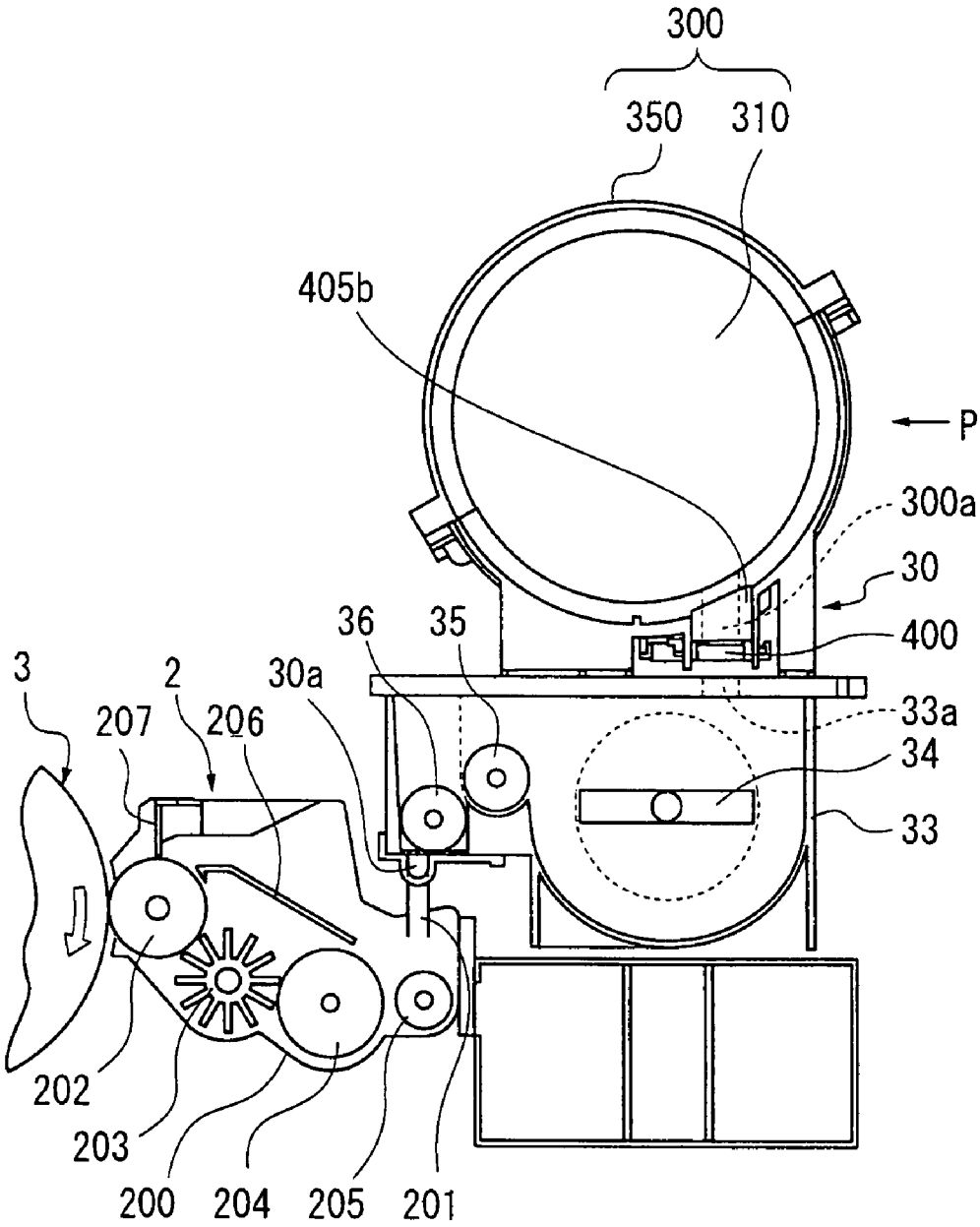
FIG. 5 is an overall sectional side view showing a developing unit and toner feed device provided for the image forming apparatus according to the same embodiment.
Figure 6:
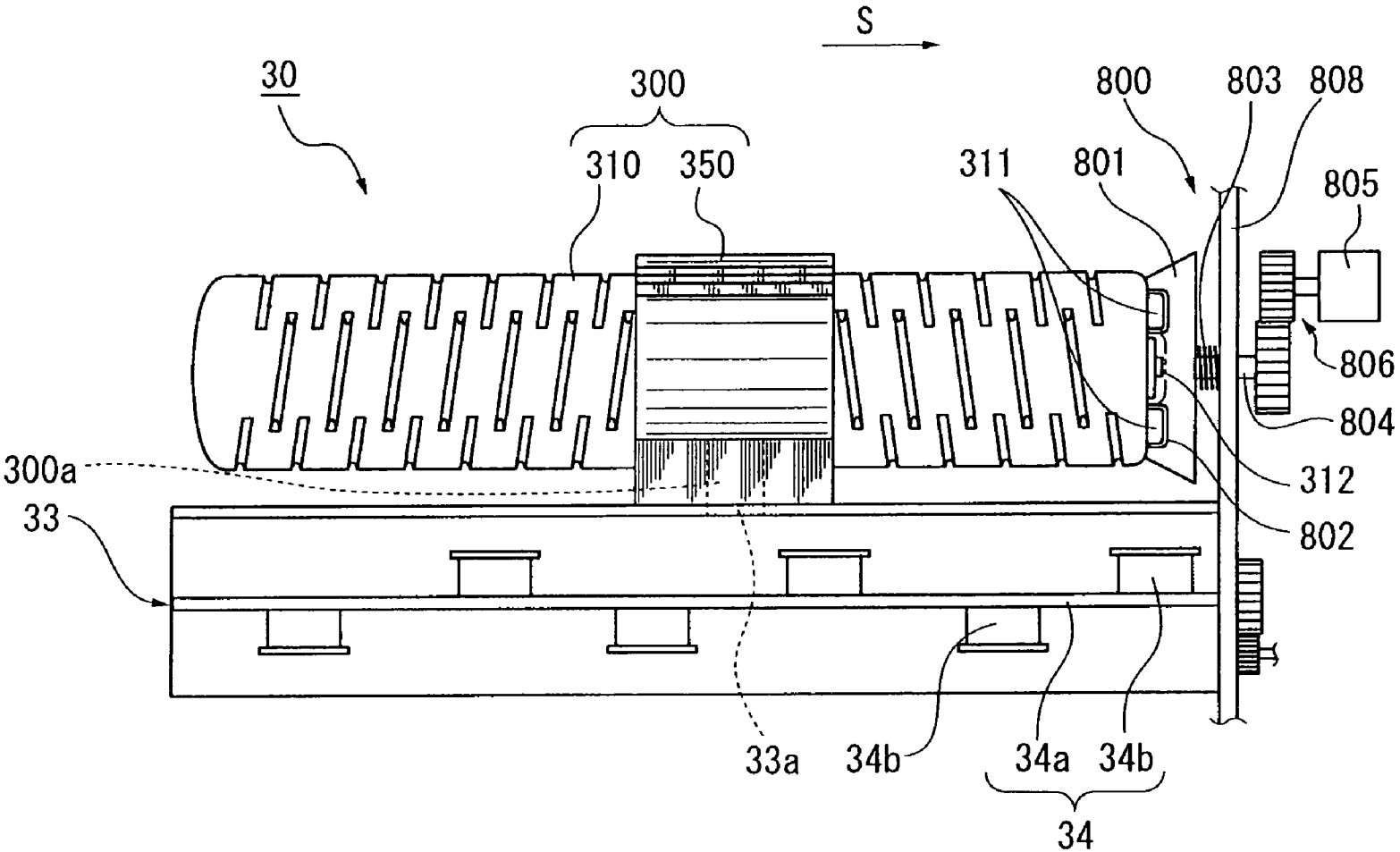
FIG. 6 is an overall front view showing the configuration of the toner feed device in the same embodiment, when viewed from the P-direction in FIG. 5.

Next, the configuration of the developing unit and toner feed device provided for the image forming apparatus according to the present embodiment will be described with reference to the drawings. FIG. 5 is an overall sectional side view showing a developing unit and toner feed device provided for the image forming apparatus according to the present embodiment. FIG. 6 is an overall front view showing the toner feed device in the present embodiment, viewed in the P-direction in FIG. 5.

As shown in FIG. 5, the exterior of developing unit 2 is formed by a hopper 200, which has a toner input port 201 for receiving toner at a position where the developing unit abuts an opening 30*a* of toner feed device 30 for supplying toner. Arranged inside hopper 200 are a developing roller 202, a paddle roller 203, a mixing roller 204, a conveying roller 205, a partitioning plate 206 and a doctor 207 as a regulating member.

In hopper 200, the toner that was fed from toner feed device 30 and input through toner input port 201 is conveyed by conveying roller 205 to mixing roller 204, where the toner is mixed with a magnetic carrier to thereby prepare a dual-component developer. This developer as it is being agitated by paddle roller 203 is supplied to developing roller 202 for development of electrostatic latent images and conveyed to the electrostatic latent image supported on photoreceptor drum 3. The developer supplied to developing roller 202 is regulated as to its amount of supply by doctor 207. The extra developer cut off thereby is recirculated by partitioning plate 206 so that it goes away from doctor 207.

Toner feed device 30 is arranged adjacent to developing unit 2, and temporarily reserves the toner discharged from toner container 300 filled with toner, in intermediate hopper 33 and then feeds the toner to developing unit 2. In the present embodiment, toner container 300 is configured so that container body 310 charged with toner is rotatably supported by a supporting structure 350.

As shown in FIG. 6, one side end of container body 310 of toner container 300 is coupled to a main body-side coupler 800 arranged on the main body of image forming apparatus 1A. Main body-side coupler 800 has an approximately disk-shaped joint socket 801 which is rotated by driving force from a drive source 805 such as a motor etc., of image forming apparatus 1A. This joint socket 801 and container body 310 are coupled to each other. Describing the coupling of these in further detail, a recessed fitting arrangement 802 for receiving fitting projections 311 and a refill port cap 312 arranged on one side end of container body 310 is provided for joint socket 801. As toner container 300 is moved so that one end of container body 310 where fitting projections 311 and refill port cap 312 are formed advances toward joint socket 801 (in the S-direction shown in FIG. 6), fitting projections 311 and refill port cap 312 fit into recessed fitting arrangement 802 formed in joint socket 801 when toner container 300 is mounted to image forming apparatus 1A. Thus container body 310 is coupled to joint socket 801. In the state where container body 310 is being coupled to joint socket 801, toner container 300 is set on intermediate hopper 33, and a toner feed aperture 300*a* formed in supporting structure 350 of container body 310 and an opening 33*a* formed in intermediate hopper 33 are positioned so as to establish communication therebetween.

As shown in FIG. 6, joint socket 801 is attached to a rotary shaft 804 so that its center corresponds to the rotational center of rotary shaft 804 that penetrates through a chassis 808 of image forming apparatus 1A. A spring member 803 such as a compression coil spring or the like is attached on rotary shaft 804 between chassis 808 and joint socket 801. Spring member 803 urges joint socket 801 in such a direction as to bring the socket away from chassis 808. Therefore, in order that toner feed device 30 will press joint socket 801, an unillustrated limiting member is provided so that movement of toner feed device 30 in the direction of attachment is limited.

As described above, in toner feed device 30 mounted to image forming apparatus 1A, the driving force from drive source 805 of image forming apparatus 1A is transmitted to joint socket 801 by way of a speed reducer 806 such as gears etc. and rotary shaft 804, so as to turn this joint socket 801. As a result, container body 310 rotates about the cylinder axis of container body 310 so as to discharge toner from container body 310 and send it out to intermediate hopper 33 through toner feed aperture 300*a* formed in supporting structure 350.

The toner thus sent out to intermediate hopper 33 is agitated therein by an agitator 34 first. Agitator 34 is composed of an agitator shaft 34*a* and agitating vanes 34*b* attached thereto, as shown in FIG. 6. As agitator shaft 34*a* turns, agitating vanes 34*b* rotate about agitator shaft 34*a* to thereby agitate the toner in intermediate hopper 33 that has been fed from toner container 300. The toner thus agitated by agitator 34 is sent by the agitating action of agitator 34 and conveyed to the feed roller 36 (FIG. 5) side via conveying roller 35 (FIG. 5). Feed roller 36 sends out the toner that has been conveyed from agitator 34 via conveying roller 35 to opening 30*a* that is formed at the position where intermediate hopper 33 abuts developing unit 2, to thereby supply the toner to developing unit 2.

Provided on the bottom side (the underside when toner container 300 is mounted on image forming apparatus 1A) of supporting structure 350 of toner container 300 is a shutter opening and closing mechanism 400 for opening and closing toner feed aperture 300*a* through which toner from toner container 300 is discharged out of supporting structure 350, as shown in FIG. 5. Specifically, as toner feed aperture 300*a* of supporting structure 350 is released by shutter opening and closing mechanism 400, communication between toner feed aperture 300*a* and opening 33*a* provided for intermediate hopper 33 is established, so that the toner discharged from toner container 300 is supplied to intermediate hopper 33. Here, the configuration and operation of shutter opening and closing mechanism 400 in the present embodiment will be described later.

Figure 7:
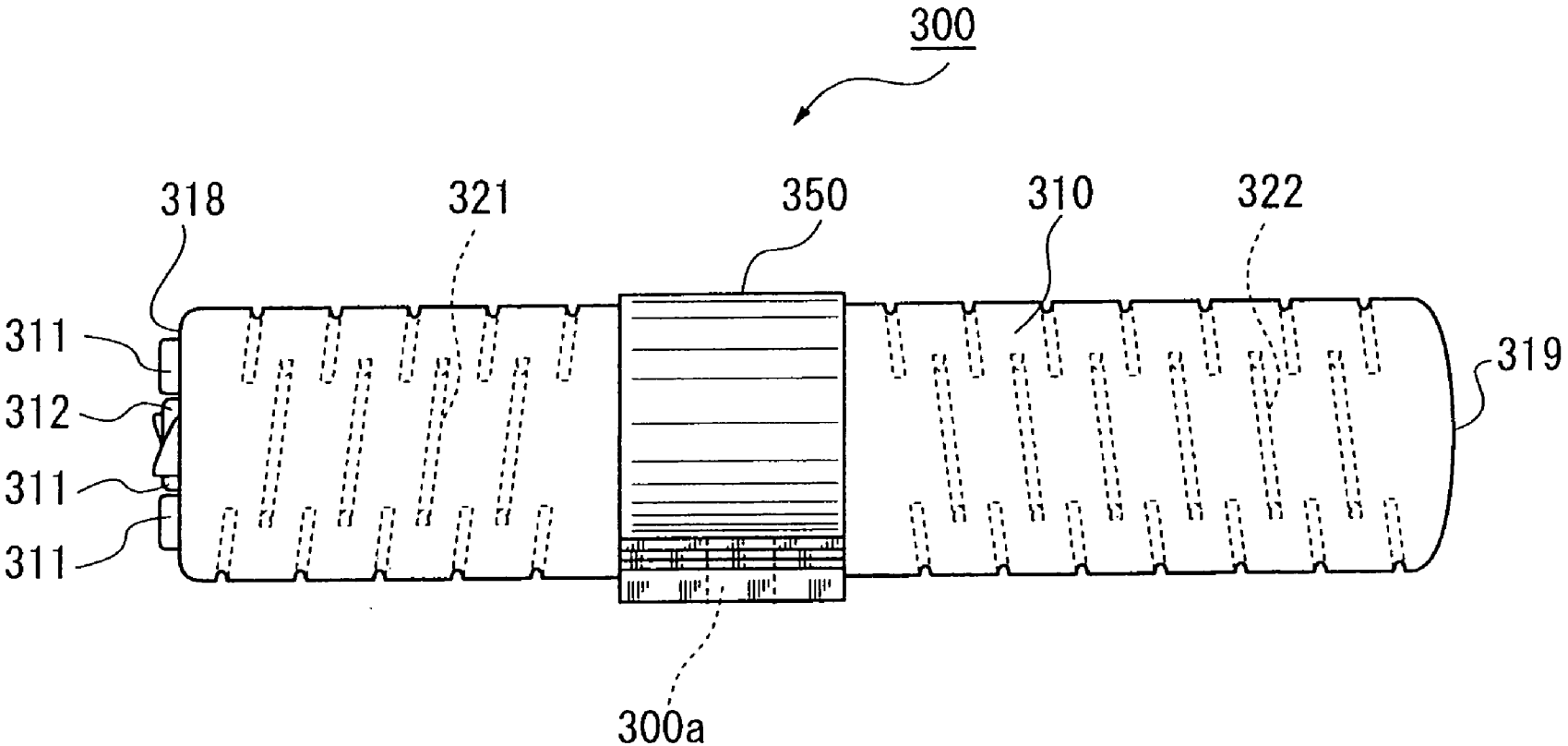
FIG. 7 is a front view showing a toner container in the same embodiment.
Figure 8:
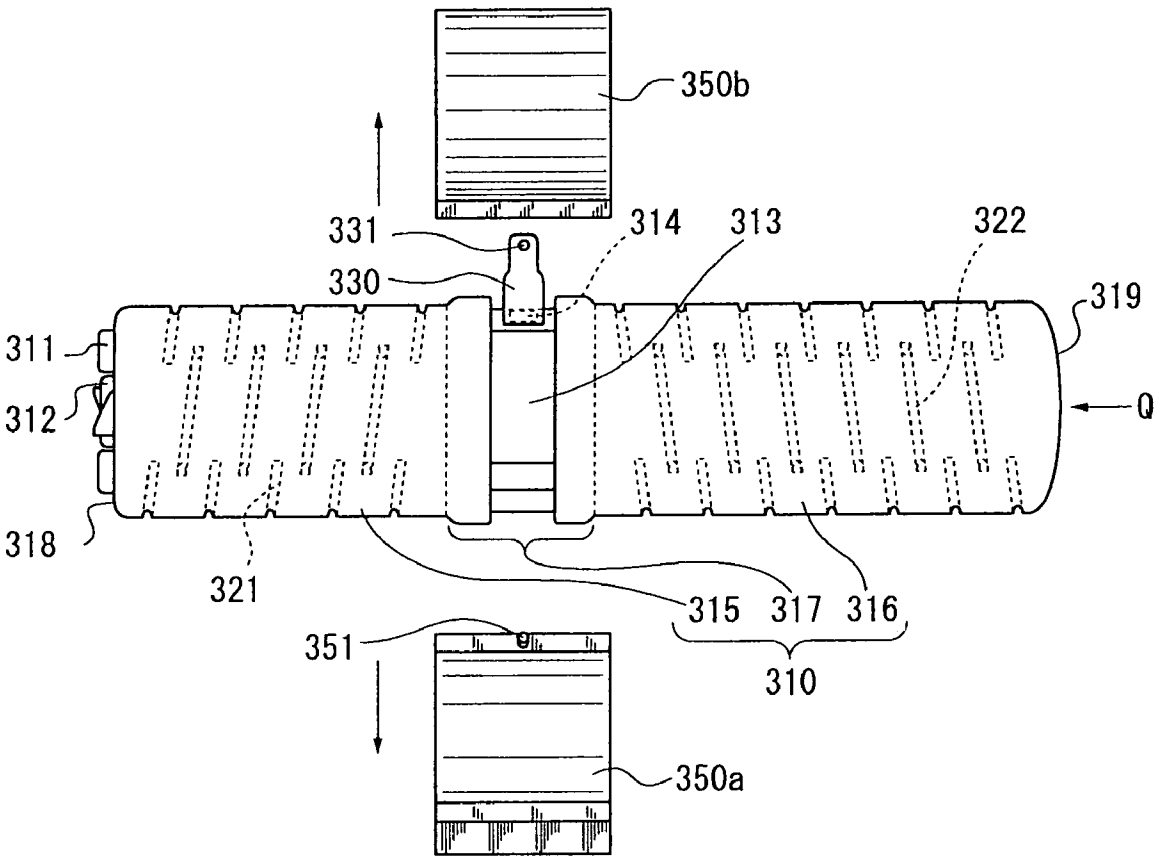
FIG. 8 is a front view showing how the toner container of the same embodiment is assembled.
Figure 9:
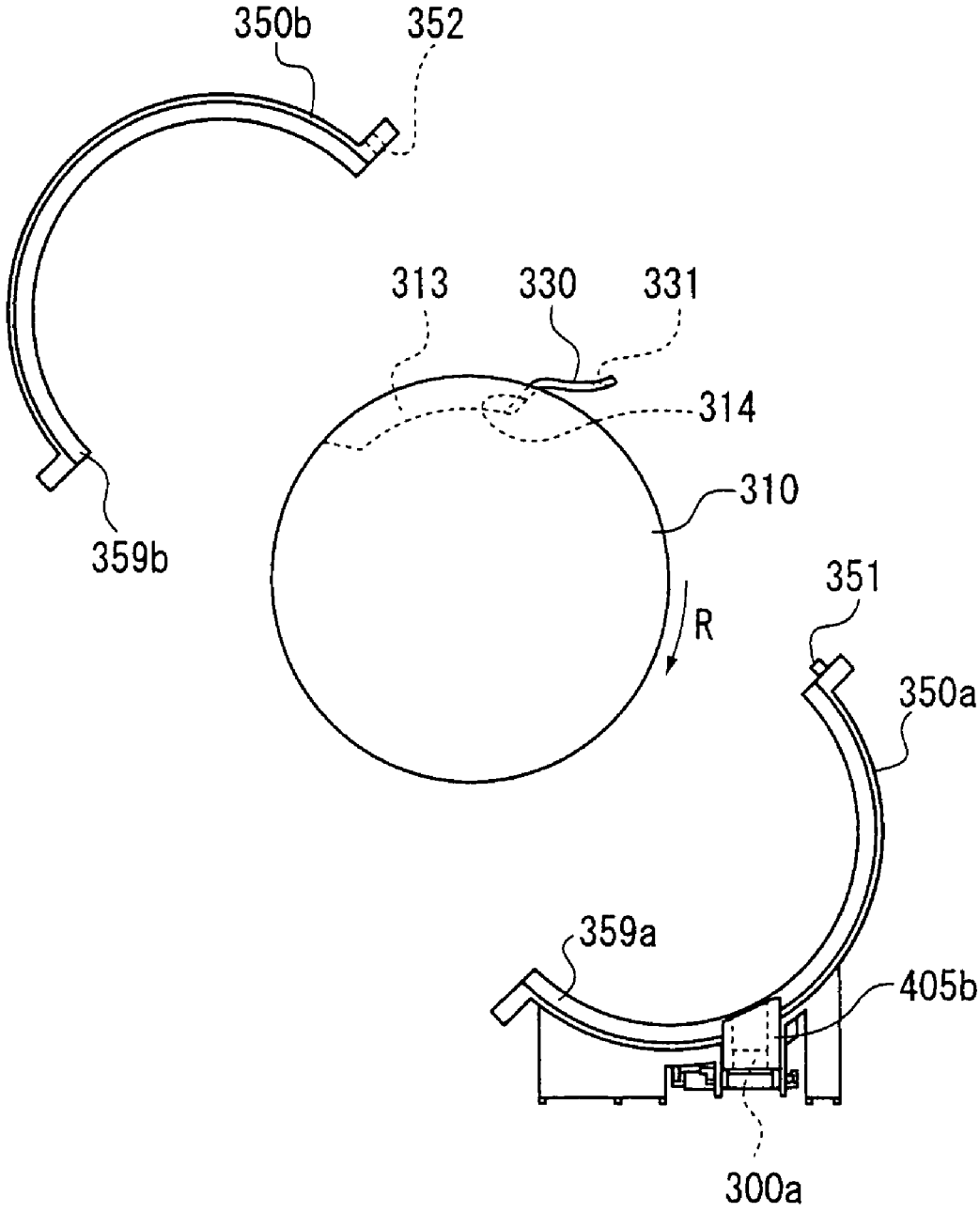
FIG. 9 is a side view, viewed in the Q-direction in FIG. 8.
Figure 10:
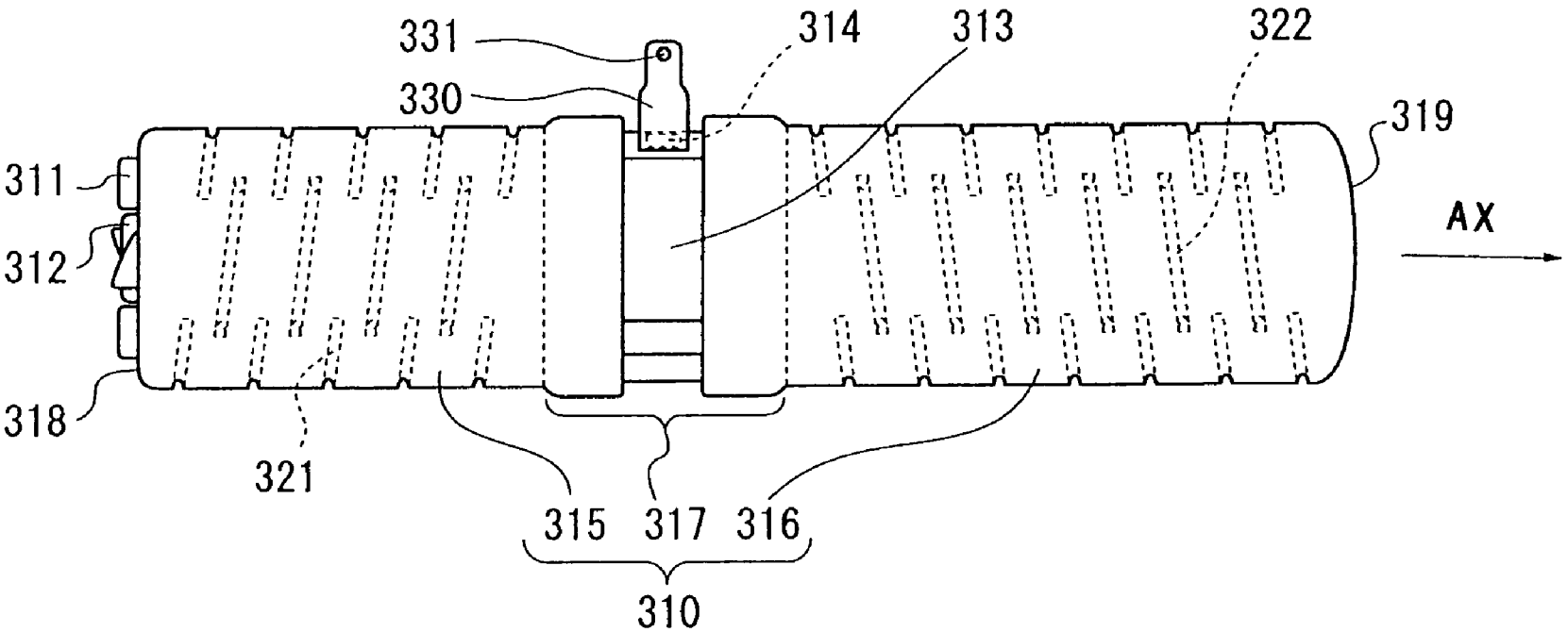
FIG. 10 is a front side view of the container body in the same embodiment.
Figure 11A:
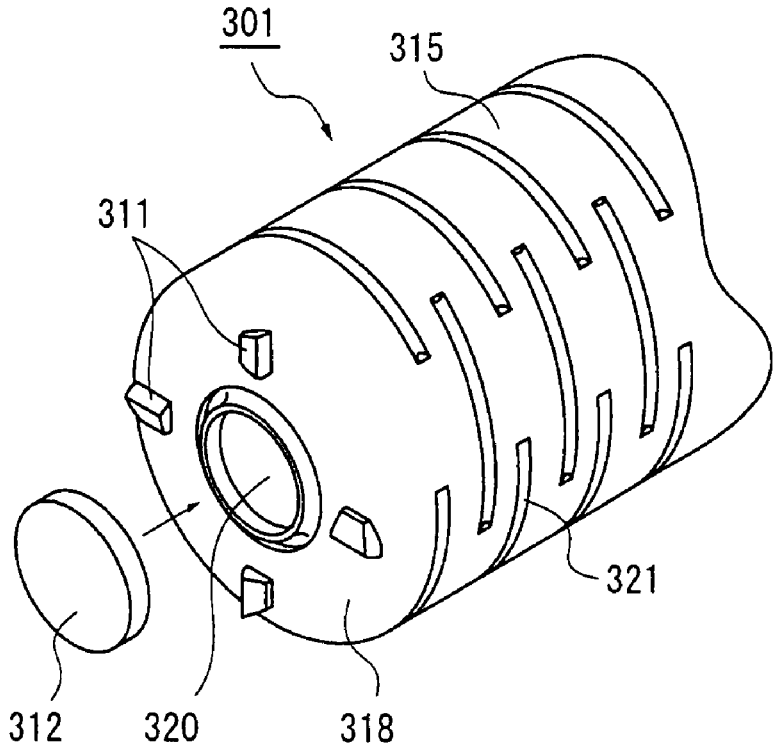
FIG. 11A is a perspective view showing the end part of the container body in the same embodiment, at the side coupled to the main body-side coupler.
Figure 11B:
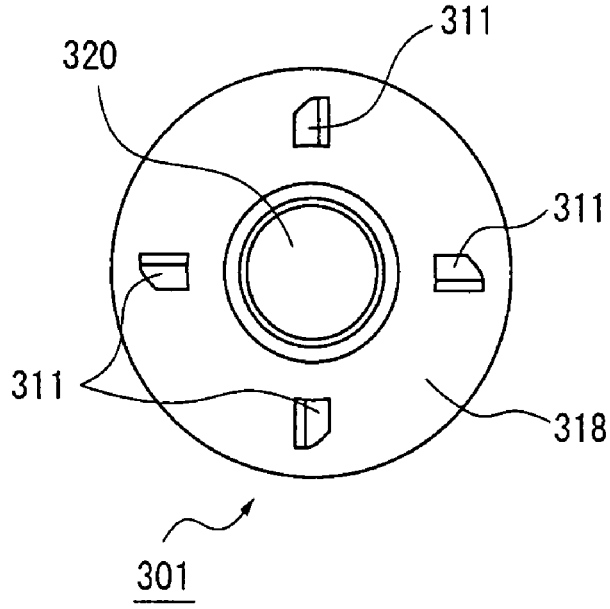
FIG. 11B is a front view of the same end part.
Figure 12:
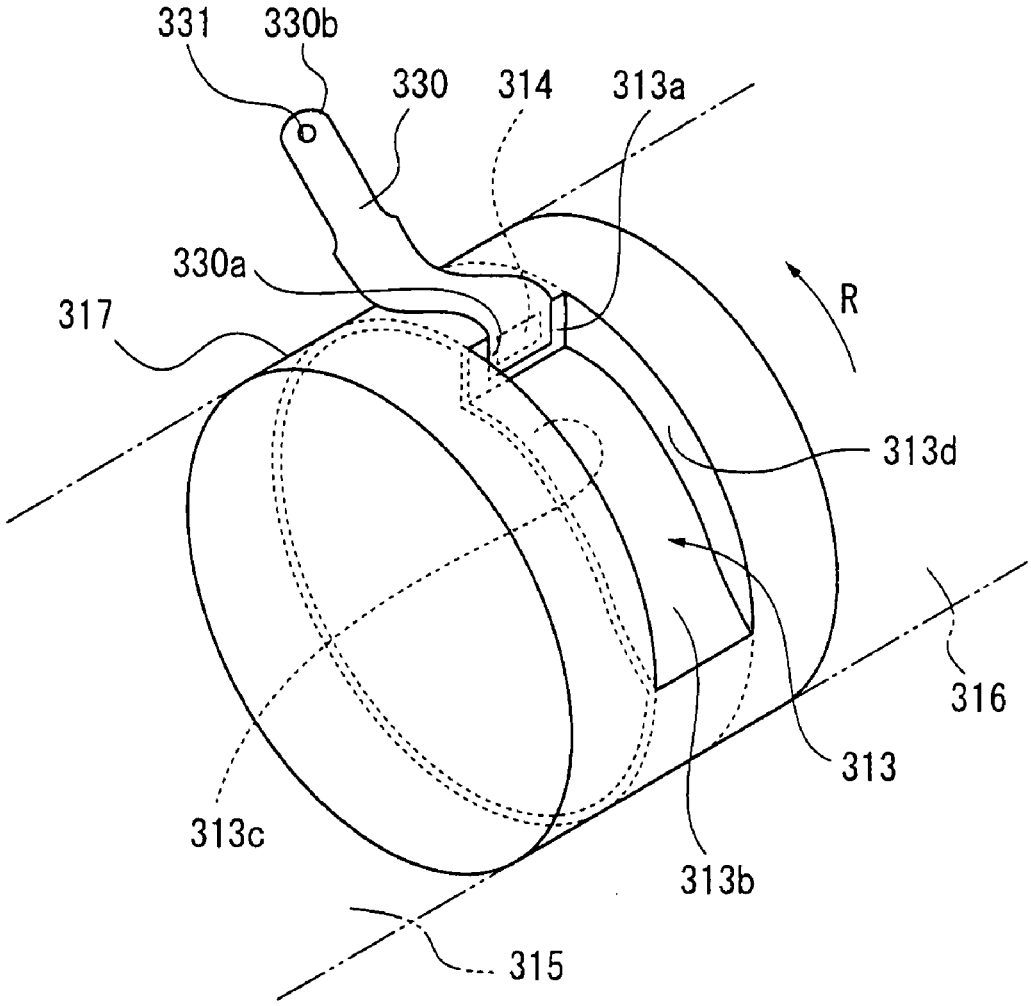
FIG. 12 is a partial perspective view for explaining the configuration around a toner discharge aperture of the container body in the same embodiment.
Figure 13A:
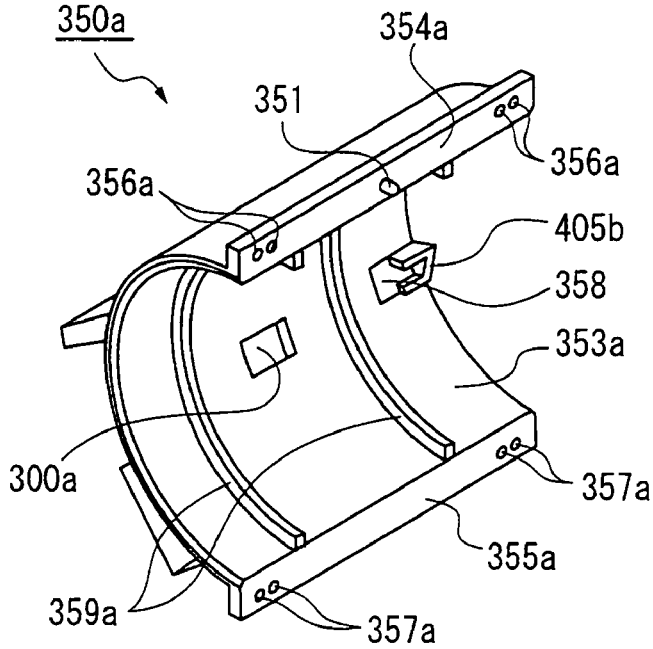
FIG. 13A is a perspective view showing a configuration of a first supporting member of a supporting structure in the same embodiment.
Figure 13B:
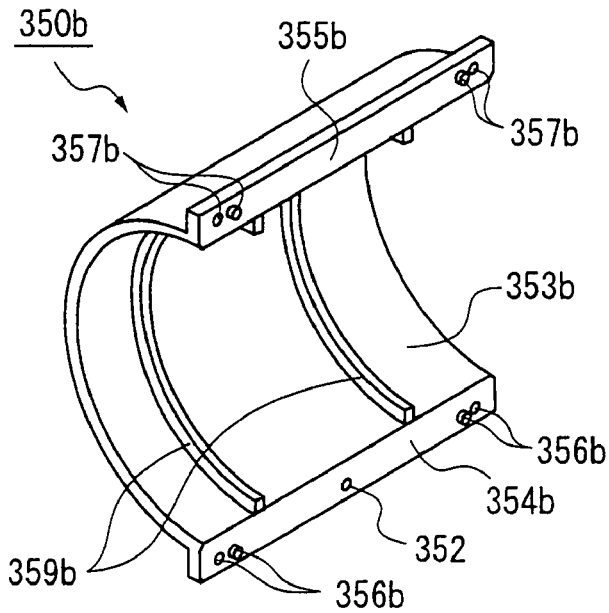
FIG. 13B is a perspective view showing a configuration of a second supporting member of the supporting structure in the same embodiment.

Next, the configuration of the toner container in the present embodiment will be described with reference to the drawings. FIG. 7 is a front view showing a toner container in the present embodiment; FIG. 8 is a front view showing how the toner container of the present embodiment is assembled; and FIG. 9 is a side view, viewed in the Q-direction in FIG. 8. Here, FIGS. 7 and 8 are front views, viewed in the direction opposite to the P-direction in FIG. 5. FIG. 10 is a front view of the container body in the present embodiment. FIG. 11A is a perspective view showing the end part of the container body of the present embodiment, at the side coupled to the main body-side coupler; FIG. 11B is a front view of the same end part; FIG. 12 is a partial perspective view for explaining the configuration around the toner discharge aperture of the container body in the present embodiment; FIG. 13A is a perspective view showing a configuration of a first supporting member of a supporting structure in the present embodiment; and FIG. 13B is a perspective view showing a configuration of a second supporting member of the supporting structure in the present embodiment.

As described already, toner container 300 (FIG. 7) has a configuration including approximately cylindrical container body 310 and supporting structure 350. As shown in FIGS. 8 and 9, container body 310 is rotatably supported by supporting structure 350 assembled of approximately semi-cylindrical first and second supporting members 350*a* and 350*b*.

Container body 310 is composed of, as shown in FIG. 10, three approximate cylinders, namely, first container part 315, second container part 316 and third container part 317. Each of these container parts is integrally formed by blow molding of a synthetic resin such as polyphenylene ether, polyethylene or the like, for example. The aforementioned third container part 317 is disposed between first and second container parts 315 and 316. The first and second container parts 315 and 316 have bottom portions 318 and 319, respectively, which constitute the bottoms of cylindrical container body 310. The thus constructed container body 310 has a toner storing portion for storing toner therein. Formed on the outer peripheral surface at the approximate center of third container part 317 of container body 310 is a toner feed recess 313, depressed radially inwards. At one end of this toner feed recess 313 there is a toner discharge aperture 314 (FIG. 8) for discharging toner from toner container 310, as will be described below. The thus constructed container body 310 is rotated about the cylinder axis AX along the length of container body 310 as third container part 317 of container body 310 is being supported by supporting structure 350, so that toner is discharged from toner discharge aperture 314 to toner feed recess 313 which is formed on the outer peripheral surface of toner container 310. Here, the Q-direction in FIG. 8 is the same as the direction in which cylinder axis AX extends.

First container part 315 (FIGS. 8 and 10) is arranged on the side where the aforementioned main body-side coupler 800 (see FIG. 6) of the image forming apparatus is located. Accordingly, bottom portion 318 of first container part 315 is formed with four fitting projections 311 that project from bottom 318 as a coupler to be coupled with main body-side coupler 800, as shown in FIGS. 11A and 11B. These fitting projections 311 are arranged so that opposing fitting projections are positioned essentially point symmetrically about the center of bottom portion 318 or the cylinder axis AX of approximately cylindrical container body 310. Toner feed device 30 is attached to main body-side coupler 800 of image forming apparatus 1A by means of these fitting projections 311, and container body 310 receives driving force from a drive source from image forming apparatus 1A and rotates about cylinder axis AX.

Further, bottom portion 318 has an opening penetrating therethrough as a toner supply port 320, to which refill port cap 312 is removably fitted. Toner refill port 320 is provided to refill container body 310 of toner container 300 with toner and is formed in the center of bottom portion 318 in a circular shape centered at the aforementioned cylinder axis. Refill port cap 312 totally covers toner refill port 320 and seals it. This refill port cap 312 is fitted to toner refill port 320 in such a manner that it will not come off due to rotation of container body 310 about the cylinder axis. Further, refill port cap 312 is adapted to be detached from toner refill port 320 when toner is loaded from toner refill port 320 into container body 310.

Formed on the inner surface of the peripheral side of the aforementioned first container part 315 (to be referred to as inner peripheral surface) are a plurality of conveyor elements 321 in order to convey the toner inside container body 310 of toner container 300 along the direction of the cylinder axis. These conveyor elements 321 are formed projectively from the inner peripheral surface toward the cylinder axis AX (radially inwards of container body 310), at regular intervals with respect to the peripheral direction and the cylinder axis direction of first container part 315. Conveyor elements 321 are arranged parallel to each other in the cylinder axis direction.

The aforementioned conveyor elements 321 are formed being inclined at a predetermined angle with the direction of a line that lies on the inner peripheral surface and is perpendicular to the cylinder axis AX of container body 310, in order to convey toner from the bottom portion 318 side toward third container part 317 (FIG. 10). In other words, each of these conveyor elements 321 is formed so that its downstream end is located closer to third container part 317 having toner discharge aperture 314 (FIG. 8) than its upstream end, with respect to the direction of rotation of container body 310 about the cylinder axis.

Second container part 316 is formed with bottom portion 319 of container body 310 and arranged in approximately cylindrical container body 310 at the end that is opposite to the side where main body-side coupler 800 (see FIG. 6) provided for image forming apparatus 1A is laid out, as shown in FIG. 10. The inside diameter of second container part 316 is formed so as to be equal to that of first container part 315.

Formed on the inner peripheral surface of second container part 316 are a plurality of conveyor elements 322 in order to convey the toner inside container body 310 along the direction of the cylinder axis AX. These conveyor elements 322 are formed projectively from the inner peripheral surface toward the cylinder axis, at regular intervals with respect to the peripheral direction and the direction of cylinder axis AX of second container part 316. Conveyor elements 322 are arranged parallel to each other.

The aforementioned conveyor elements 322 are formed being inclined at a predetermined angle with the direction of a line that lies on the inner peripheral surface and is perpendicular to the cylinder axis AX of container body 310, in order to convey toner from the bottom portion 319 side toward third container part 317. In other words, each of these conveyor elements 322 is formed so that its downstream end is located closer to third container part 317 having toner discharge aperture 314 than its upstream end, with respect to the direction of rotation of container body 310 about the cylinder axis.

In the above way, since container body 310 of toner container 300 of the present embodiment has third container part 317 between first container part 315 and second container part 316, the inclination of conveyor elements 322 formed in second container part 316 is formed opposing that of conveyor elements 321 formed in first container part 315. As a result, as container body 310 rotates about the cylinder axis (in the R-direction in FIG. 9), the toner stored in the first container part 315 and the toner stored in the second container part 316 move towards third container part 317, being guided by conveyor elements 321 and 322 from bottom portions 318 and 319 of container body 310, respectively.

As described above, third container part 317 is the portion that is rotatably supported by supporting structure 350, and its inside diameter is formed marginally greater than that of first and second container parts 315 and 316, as shown in FIGS. 8 and 10. With this configuration, the toner conveyed from the first and second container parts 315 and 316 can be correctly conveyed and brought down into third container part 317, so that it is possible to constantly hold a uniform amount of toner inside third container part 317. Accordingly, even when container body 310 stops rotating, third container part 317 holds a predetermined amount of toner, so that it is possible to give a stable supply of toner immediately after container body 310 is restarted to rotate. Further, since a fixed amount of toner can be held in third container part 317 if the remaining amount of toner in container body 310 has become lower, it is possible to make stable supply of toner over a long period.

As shown in FIG. 12, third container part 317 is formed with a toner feed recess 313 that has a predetermined width with respect to the cylinder axis AX of container body 310 and extends on the outer peripheral surface of container body 310 around the circumference of the outer peripheral surface in the rotational direction of container body 310. This toner feed recess 313 is formed so that it sinks from the outer surface of the peripheral side of third container part 317 (to be mentioned hereinbelow as the outer peripheral surface) toward the cylinder axis AX. The thus configured toner feed recess 313 serves as a space for holding the toner discharged from container body 310 and is also used as a space for delivering toner from toner feed recess 313 to toner feed aperture 300*a* (FIGS. 7 and 9) formed in supporting structure 350. Further, since toner feed recess 313 is formed in a depressed configuration on the outer peripheral surface of third container part 317, it is possible to reduce the contact surface between third container part 317 and supporting structure 350 during rotation of container body 310. As a result, the friction between supporting structure 350 and container body 310 during rotation of container body 310 can be reduced so as to realize smooth rotation of container body 310 of toner container 300.

As shown in FIG. 12, toner feed recess 313 is defined by an end wall portion 313*a*, a bottom wall portion 313*b*, a first side wall portion 313*c* and a second wall portion 313*d*. End wall portion 313*a* is arranged at the downstream end of toner feed recess 313 with respect to the rotational direction R of container body 310 and formed approximately perpendicularly to the outer peripheral surface of third container part 317. Formed in end wall portion 313*a* is a toner discharge aperture 314 as an opening connected to the interior of container body 310 in order to discharge toner from container body 310 to toner feed recess 313.

Bottom wall portion 313*b* is arranged extending in the rotational direction R so that its downstream end with respect to the rotational direction R is connected to end wall portion 313*a* while its upstream end is smoothly connected to the outer peripheral surface of third container part 317. That is, bottom wall portion 313*b* is formed roughly parallel to the outer peripheral surface and closer to cylinder axis AX than the outer peripheral surface of third container part 317 is.

The aforementioned first side wall portion 313*c* and second side wall portion 313*d* are arranged so as to be approximately parallel to each other and vertical to the outer peripheral surface of third container part 317 and bottom wall portion 313*b*, forming both sides of toner feed recess 313, i.e., the both sides with respect to the direction of cylinder axis AX of container body 310. The aforementioned first side wall portion 313*c* and second side wall portion 313*d* are each connected at their downstream ends with respect to the rotational direction R of container body 310 to end wall portion 313*a* while their upstream ends are connected to the outer peripheral surface of third container part 317. Further, first side wall portion 313*c* and second side wall portion 313*d* are each connected to the outer peripheral surface of third container part 317 at their upstream and downstream sides with respect to the rotational direction R.

Further, third container part 317 is formed with an enclosing seal 330 (sealing element) as a sealing element for bonding and sealing toner discharge aperture 314 provided in toner feed recess 313, as shown in FIG. 12. As shown in FIGS. 9 and 12, enclosing seal 330 is formed in an approximate arc shape with a predetermined length in the peripheral direction of container body 310 and arranged along the end face on which toner discharge aperture 314 of container body 310 is formed. One end 330*a* of enclosing seal 330 is bonded to toner discharge aperture 314 so as to seal off the toner discharge aperture 341 of toner feed recess 313. On the other hand, the other end 330*b* of enclosing seal 330 is formed with an engaging hole 331, which is fixed to supporting structure 350 by engagement with a supporting structure-side engaging projection 351 (FIG. 9) formed in supporting structure 350.

As third container part 317 of container body 310 is constructed as above, when enclosing seal 330 is peeled off by rotation of container body 310 of toner container 300, second end 330*b* of enclosing seal 330 is pulled by engaging projection 351 of supporting structure 350 as container body 310 rotates in the direction of arrow R, and the first end 330*a* of enclosing seal 330 is peeled off toner discharge aperture 314 so as to open toner discharge aperture 314. In contrast, when container body 310 rotates in the direction opposite the direction of arrow R, the second end 330*b* of enclosing seal 330 is hooked by supporting structure-side engaging projection 351 provided for supporting structure 350 (first supporting member 350*a*). As a result, the rotation of container body 310 in the opposite direction can be prevented, thus stabilizing container body 310 so as not to be rattled while toner container 300 is being conveyed or the like.

As to the material of enclosing seal 330, polyethylene terephthalate (PET) and the like can be used. However, the material is not limited to this. That is, other materials such as polyethylene, polypropylene, felt and the like may be used as long as they present air permeability, good slidability and can bond and seal toner discharge aperture 314. In the present embodiment, the enclosing seal 330 is formed of a sheet of paper made of polyester (PET) or the like, being coated with a felt made of extra fine polyethylene fiber, specifically, a product of Du Pont Kabushiki Kaisha "Tyvek (registered trademark)".

On the other hand, supporting structure 350 is constructed of, as already described, approximately semi-cylindrical first and second supporting members 350*a* and 350*b*, and this supporting structure 350 rotatably supports third container part 317 located in the approximate center of container body 310.

First supporting member 350*a* has an approximately semi-cylindrical configuration as shown in FIG. 13A and is formed with the aforementioned toner feed aperture 300*a* at the approximate center of its inner curved surface portion 353*a*. Also formed at the approximately center of inner curved surface 353*a* of first supporting member 350*a* is a regulating recess 358 into which a regulating member 405*b* (FIG. 15) for limiting the range of movement of the closing operation of a shutter element 401 (FIG. 15) of the aftermentioned shutter opening and closing mechanism 400 fits (in FIG. 13A a state where regulating member 405*b* has fitted therein is shown).

Further, in order to secure the clearance for rotation of container body 310 as well as to secure the stability in supporting container body 310 by supporting structure 350 when container body 310 is supported by supporting structure 350, a pair of rib-like container body engaging portions 359*a* (FIG. 13) are formed on inner curved surface portion 353*a*. These container body engaging portions 359*a* are arranged in parallel to each other and spaced approximately the same distance as the width (the dimension in the direction of cylinder axis AX) of third container part 317. These engaging portions 359*a* are connected to corresponding container body engaging portions 359*b* formed on the aftermentioned second supporting member 350*b* when first supporting member 350*a* and second supporting member 350*b* are assembled to complete supporting structure 350. The thus constructed paired ribs of container body engaging portions 359*a* and 359*b* and inner peripheral curved surfaces 353*a* and 353*b* hold third container part 317 to thereby support container body 310 in a rotatable manner on supporting structure 350.

In addition, both the side edges (the parts that are connected to second supporting member 350*b*) of inner curved surface portion 353*a* are formed with first and second flanges 354*a* and 355*a*. In each of flanges 354*a* and 355*a*, fitting recesses 356*a* or 357*a* are formed at both longitudinal ends of the flange and are fitted to corresponding fitting projections 356*b* or 357*b* formed at both longitudinal ends of the flange 354*b* or 355*b* of aftermentioned second supporting member 350*b*. Formed at the approximate center of first flange 354*a* is a supporting structure-side engaging projection 351 for engagement with engaging hole 331 formed at the other end 330*b* of enclosing seal 330 (FIG. 8). Further, formed on the outer side of first supporting member 350*a*, at the position where toner feed aperture 300*a* is arranged, is shutter opening and closing mechanism 400 (FIG. 14) for opening and closing toner feed aperture 300*a*. The configuration and operation of shutter opening and closing mechanism 400 will be described later.

Second supporting member 350*b* also has an approximately semi-cylindrical configuration as shown in FIG. 13B. Similarly to first supporting member 350*a*, in order to secure the clearance for rotation of container body 310 as well as to secure the stability in supporting container body 310 by supporting structure 350 when container body 310 is supported by supporting structure 350, a pair of rib-like container body engaging portions 359*b* are formed on inner curved surface portion 353*b*. These container body engaging portions 359*b* are arranged in parallel to each other and spaced approximately the same distance as the width of third container part 317. In addition, both the side edges of inner curved surface portion 353*b* are formed with first and second flanges 354*b* and 355*b*. In each of flanges 354*b* and 355*b*, fitting projections 356*b* or 357*b* are formed at both longitudinal ends of the flange and are fitted correspondingly to the aforementioned fitting recesses 356 or 357*a* formed at both longitudinal ends of the flange 354*a* or 355*a* of the aforementioned first supporting member 350*a*. Formed at the approximate center of first flange 354*b* is an engaging recess 352 that fits supporting structure-side engaging projection 351 formed in first flange 354*a* of first supporting member 350*a*.

As first supporting member 350*a* and second supporting member 350*b* are thus configured as above, first flange 354*a* of first supporting member 350*a* is joined to first flange 354*b* of second supporting member 350*b*, and second flange 355*a* of first supporting member 350*a* is joined to second flange 355*b* of second supporting member 350*b*, to thereby complete the approximately cylindrical supporting structure 350 which supports container body 310 in a rotatable manner over the whole circumference.

Figure 14A:
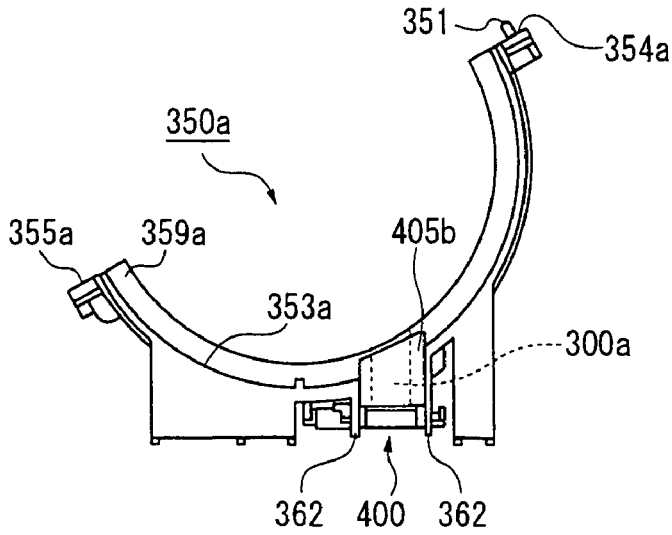
FIG. 14A is a side view showing the first supporting member of the supporting structure of the toner container in the same embodiment.
Figure 14B:
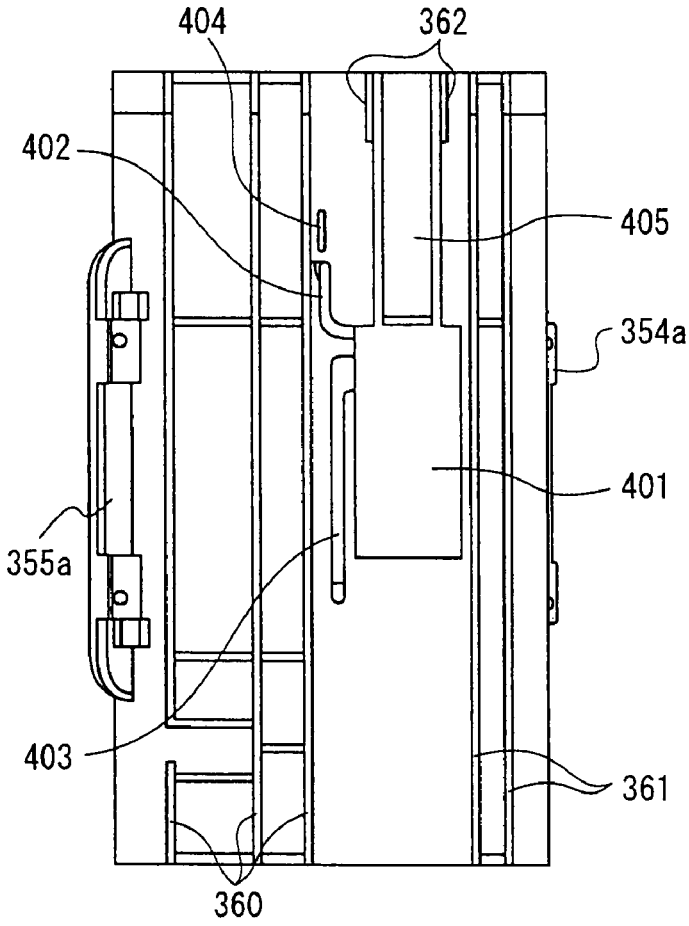
FIG. 14B is a plan view showing the first supporting member, viewed from its bottom side.
Figure 15A:
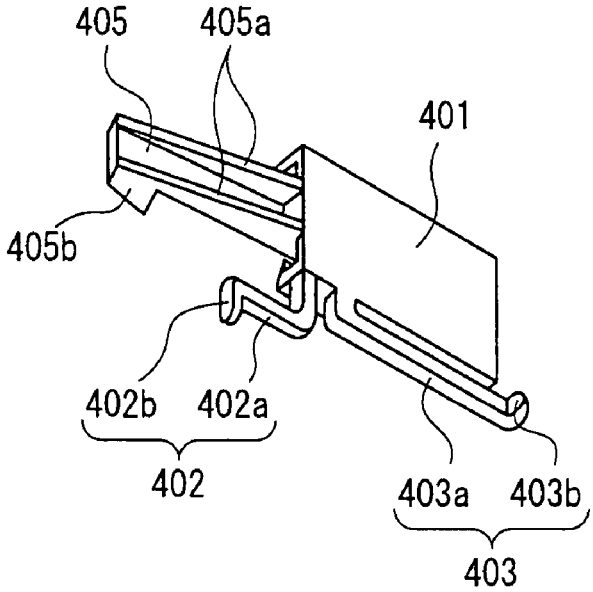
FIG. 15A is a perspective view showing a shutter element provided for a shutter opening and closing mechanism in the same embodiment, viewed from its front.
Figure 15B:
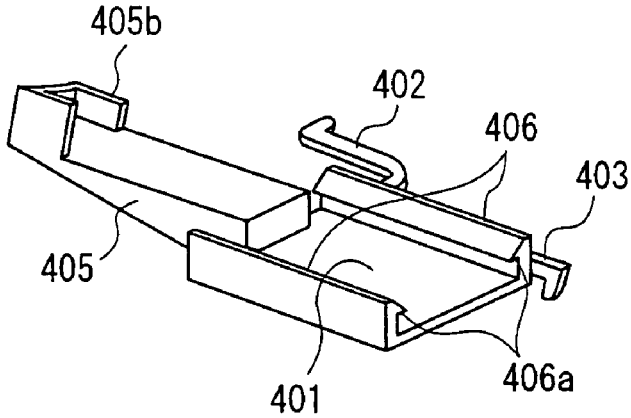
FIG. 15B is a perspective view showing the same shutter element, viewed from its rear.
Figure 15C:
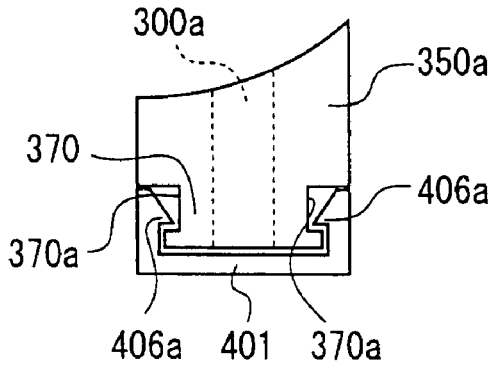
FIG. 15C is an illustrative view showing a state in which the shutter element is attached to the first supporting member.

Next, the shutter opening and closing mechanism provided for the first supporting member in the supporting structure of the toner container of the present embodiment will be described with reference to the drawings. FIG. 14A is a side view showing the first supporting member of the supporting structure of the toner container in the present embodiment; FIG. 14B is a plan view showing the first supporting member, viewed from its bottom side; FIG. 15A is a perspective view showing the shutter element provided for the shutter opening and closing mechanism in the present embodiment, viewed from its front; FIG. 15B is a perspective view showing the same shutter element, viewed from its rear; and FIG. 15C is an illustrative view showing the way in which the shutter element is attached to the first supporting member.

As described above, first supporting member 350*a* (FIG. 14) is formed in a semi-cylindrical shape and has toner feed aperture 300*a* formed at the approximate center (FIG. 13A) of inner curved surface portion 353*a*. Formed along both side edges of inner curved surface portion 353*a* are first and second flanges 354*a* and 355*a*.

As shown in FIGS. 14A and 14B, on the bottom side of first supporting member 350*a*, a plate-formed, first fixing member 360 and second fixing member 361 (FIG. 14B) for attachment and fixture of toner container 300 to intermediate hopper 33 (FIG. 5) of toner feed device 30 are formed parallel to each other and erected outside from inner curved surface portion 353*a*. Specifically, first fixing member 360 and second fixing member 361 provide the function of a supporting base for the placement face of first supporting member 350*a* so as to hold container body 310 (FIG. 5) supported by supporting structure 350 approximately horizontal. Further, on the downstream side of toner feed aperture 300*a* (FIG. 14A) located between first fixing member 360 and second fixing member 361, a shutter opening and closing mechanism 400 for making control of discharge of the toner supplied from container body 310 to the outside by switching the state of the shutter over the opening on the downstream side of toner feed aperture 300*a* between the open and closed states is arranged. Accordingly, first fixing member 360 and second fixing member 361 are adjusted as to their height so as to establish the clearance between supporting structure 350 and intermediate hopper 33 of toner feed device 30 so that shutter opening and closing mechanism 400 will function correctly.

As shown in FIG. 14B, shutter opening and closing mechanism 400 is comprised of shutter element 401 for opening and closing toner feed aperture 300*a*, first and second regulating members 402 and 403 formed at the side of shutter element 401 and an anti-slide rib 404 formed on the bottom of first supporting structure 350*a*, standing erect with respect to the sliding surface of shutter element 401.

Shutter element 401 is an approximately rectangular plate-like member formed of a synthetic resin or the like having a certain degree of elasticity and hardness, such as POM (polyoxymethylene) or the like, and has a guide portion 405 that is extended from one end on the side from which shutter element 401 starts to open (to be referred to hereinbelow as the front end side) so as to guide the opening and closing action of shutter element 401 along the fixed direction. Guide portion 405 is integrally formed with shutter element 401, and has erected pieces 405*a* standing upright along both side edges thereof. These erected pieces 405*a* are formed inclined, reducing their height from their proximal side connected to shutter element 401 toward the distal side, as shown in FIG. 15A. On the front end side of guide portion 405, approximately U-shaped regulating member 405*b* that limits the movable range of the closing action of shutter 401 is formed erected on the opposing side of erected pieces 405*a* of guide portion 405. As described already, this regulating member is fitted into regulating recess 358 (FIG. 13A) formed at the approximate center near the side end of inner curved surface 353*a* of first supporting member 350*a*, so as to limit the movable range of the closing action of shutter element 401.

First regulating member 402 is to limit the movement of shutter element 401 before mounting toner container 300 to intermediate hopper 33. As shown in FIGS. 15A and 15B, this regulating member is composed of an approximately L-shaped main piece 402*a*, whose one end is connected to the side part of shutter element 401 and the other end being extended to the front end side, and a hook 402*b* that is formed at the front end side of this main piece 402*a* and projected outside (to the left in FIG. 14). This hook 402*b* abuts anti-slide rib 404 (FIG. 14B) so as to serve as an anti-slide portion for preventing shutter element 401 of shutter opening and closing mechanism 400 from being opened when toner container 300 has not been mounted to intermediate hopper 33. In other words, combination of first regulating member 402 and anti-slide rib 404 constitute the anti-slide portion for preventing shutter element 401 from sliding before toner container 300 is mounted to intermediate hopper 33. First regulating member 402 is formed of a material having a certain degree of elasticity and hardness such as POM (polyoxymethylene) or the like so as to slide in the width direction of shutter element 402. The details of how first regulating element 402 and anti-slide rib 404 operate to prevent shutter element 401 from sliding will be described later.

The second regulating member 403 is provided to limit the movement of shutter element 401. This is particularly used when shutter element 401 that has been opened is closed. This second regulating member 403 is composed of, as shown in FIG. 15A, an approximately L-shaped main piece 403*a*, whose one end is connected to the side part of shutter element 401 and the other end being extended in the direction opposite to first regulating member 402, and a hook 403*b* that is formed at the opposite end from the connected side of this main piece 403*a* to shutter element 401 and is projected in the direction (upwards in FIG. 15A) opposite to toner feed aperture 300*a*. Similarly to first regulating member 402, second regulating member 403 is also preferably formed of a material having a certain degree of elasticity and hardness such as POM (polyoxymethylene) or the like. The details of how second regulating element 403 operates to limit the movement of shutter element 401 will be described later.

On the other hand, formed on the underside of shutter element 401 are a pair of slide supporting elements 406 which support the shutter element to a shutter guide portion 370 (FIG. 15C) having the aforementioned toner feed aperture 300*a* of supporting structure 350 formed therein and are extended in the longitudinal direction of shutter element 401, as shown in FIG. 15B. That is, as shown in FIG. 15C, slide supporting elements 406 each have a hooking portion 406*a* formed so as to project inwards (toward the opposing side) from the both side edges of shutter element 401, whereby the shutter element can be supported in a slidable manner along, and by, slide recessed portion 370*a* formed in shutter guide portion 370.

Further, on the bottom side of first supporting member 350*a*, in other words, on the side where shutter opening and closing mechanism 400 is disposed in first supporting member 350*a*, a pair of erected portions 362 (FIG. 14) that are erected to the bottom surface are provided between the outer portion of first supporting member 350*a*, and first regulating member 402 and anti-slide rib 404, in order to prevent hands, fingers etc. from touching first regulating member 402 from the outside when toner container 300 has been set on intermediate hopper 33. In the present embodiment, these erected portions 362 are disposed in the end part on the bottom side of first supporting member 350*a* so that they abut the front end of guide portion 405.

Figure 16:
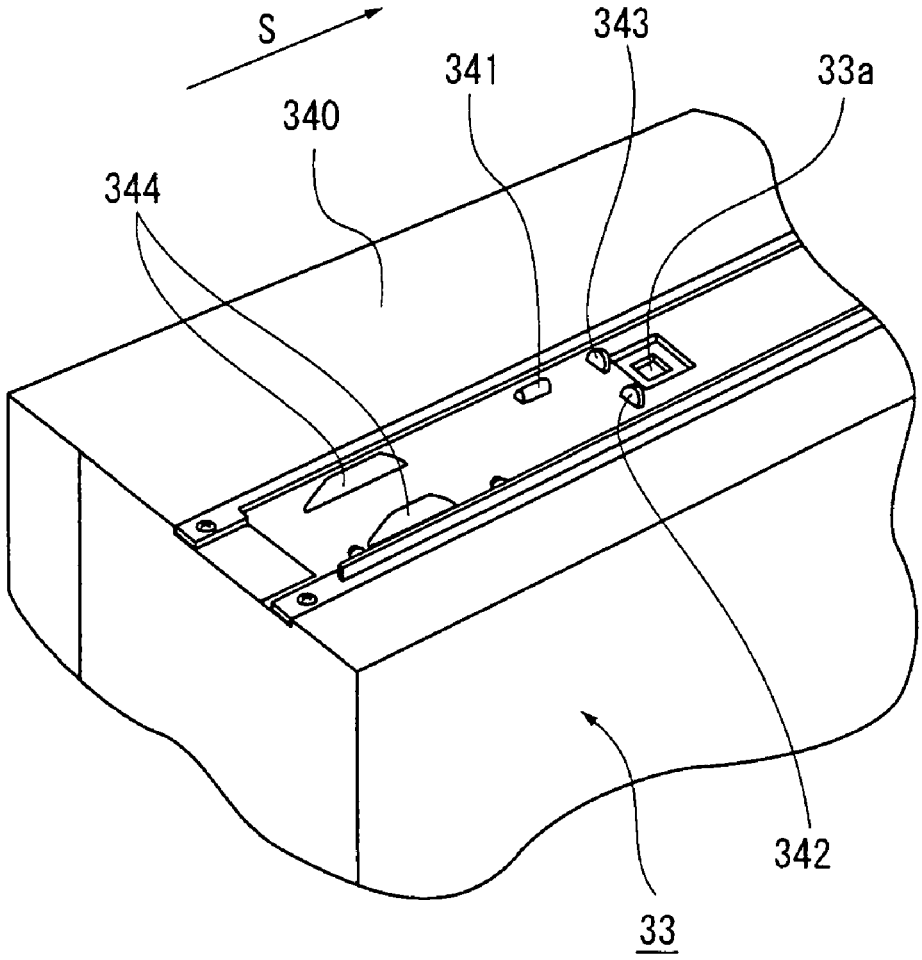
FIG. 16 is a partial perspective view showing essential parts in the mount surface of an intermediate hopper on which the toner container is mounted in the same embodiment.

Next, the configuration of the mount surface on which toner container 300 of the present embodiment is set to intermediate hopper 33 (FIG. 5) will be described with reference to the drawings. FIG. 16 is a partial perspective view showing essential parts in the mount surface of the intermediate hopper on which the toner container of the present embodiment is mounted. In FIG. 16, of the toner container mount surface in the intermediate hopper, the part located on the side opposite to the main body-side coupler 800 (FIG. 6) is shown. In this figure, arrow S represents the direction in which toner container 300 is moved so as to be mounted to the main body-side coupler, and the starting point side of arrow S is expressed as the upstream side.

In the present embodiment, the toner container mount surface 340 of intermediate hopper 33 to which supporting member 350*a* is mounted, has opening 33*a* that will communicate with toner feed aperture 300*a* when shutter opening and closing mechanism 400 is released, at the position corresponding to toner feed aperture 300*a* (FIG. 13A) provided for supporting structure 350, as shown in FIG. 16. That is, opening 33*a* is formed at such a position as to receive the toner discharged from toner feed aperture 300*a* when toner feed aperture 300*a* of supporting member 350*a* is released by shutter opening and closing mechanism 400 after toner container 300 (FIG. 7) has been mounted to toner container mount surface 340.

Arranged on the upstream side of opening 33*a* in toner container mount surface 340 is a shutter block 341 for disengaging the anti-slide function for limiting the movement of shutter element 401 of shutter opening and closing mechanism 400 for closing toner feed aperture 300*a* of supporting structure 350 when toner container 300 has been mounted to intermediate hopper 33. This shutter block 341 is an approximately triangular prism-shaped projected member having an inclined surface 341*a* (FIG. 18) and is arranged with its length approximately parallel to the S-direction. The distance from the downstream end of shutter block 341 to opening 33*a* is designed to be approximately equal to the distance from the downstream end of shutter element 401 (FIG. 15A) to hook 402*b* (FIG. 15A) of first regulating member 402. Since shutter block 341 is laid out on the upstream side of opening 33*a* of mount surface 340 in the above way, shutter block 341 abuts hook 402*b* when toner container 300 is set to intermediate hopper 33. As a result, main piece 402*a* of first regulating member 402 bends inwards so that hook 402*b* becomes deviated from anti-slide rib 404 (FIG. 14B), hence the constraint on the movement of shutter element 401 by anti-slide rib 404 is released.

Further, a first engaging projection 342 is provided at a position opposing an aftermentioned second engaging projection 343, which is arranged on the downstream side of shutter block 341 on toner container mount surface 340 and near opening 33*a*. This first engaging projection 342 is disposed at such a position as to abut shutter element 401 (FIG. 15) when toner container 300 is mounted on intermediate hopper 33 and slid in the S-direction. Accordingly, when toner container 300 is set on intermediate hopper 33 and slid in the S-direction after disengagement of the anti-slide function for limiting the movement of shutter element 401, first engaging projection 342 abuts the downstream end of shutter element 401, to thereby open shutter element 401 with the movement of toner container 300 in the S-direction.

Further, arranged on the downstream side of shutter block 341 of toner container mount surface 340 and near opening 33*a* is second engaging projection 343 opposing first engaging projection 342 as mentioned above. This second engaging projection 343 is hooked by hook 403*b* of second regulating member 403 (FIGS. 15A and 15B) of shutter opening and closing mechanism 400 when toner container 300 is dismounted from intermediate hopper 33 of toner feed device 30, so that shutter element 401 is moved by second regulating member 403 to close toner feed aperture 300*a*. That is, shutter element 401 is moved in linkage with the dismounting action of toner container 300 from intermediate hopper 33, to thereby close toner feed aperture 300*a* of toner container 300.

Also, a pair of supporting pieces 344 for supporting the rear end part (the rear end on the bottom surface 319 side (FIG. 7) of second container part 316) of container body 310 when toner container 300 is being mounted is formed in toner container mount surface 340 on the upstream side of shutter block 341 of opening 33*a*. These supporting pieces 344 are to create a predetermined clearance between container body 310 of toner container 300 and toner container mount surface 340 and contribute to smooth rotation of container body 310. The shape and configuration of these supporting pieces 344 are not particularly limited. That is, these supporting pieces may be formed in any shape with any material as long as they allow container main body 310 of toner container 300 to rotate smoothly.

Figure 17A:
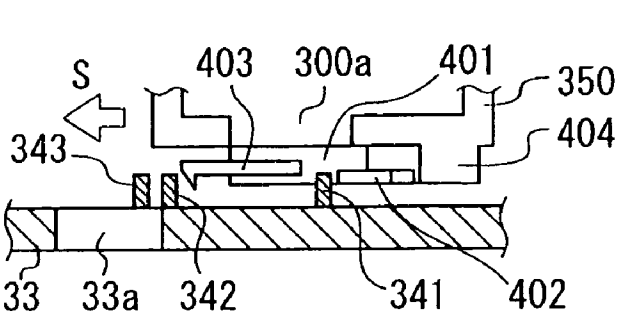
FIG. 17A is a view for illustrating how the shutter opening and closing mechanism of the toner container of the same embodiment operates before disengagement of its anti-slide function.
Figure 17A:
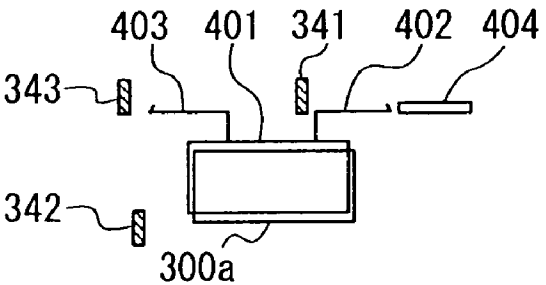
Figure 17B:
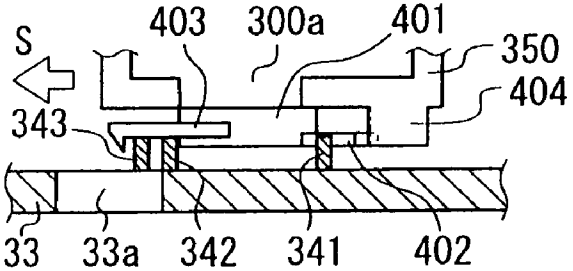
FIG. 17B is a view for illustrating how the shutter opening and closing mechanism of the toner container of the same embodiment operates after disengagement of the anti-slide function.
Figure 17B:
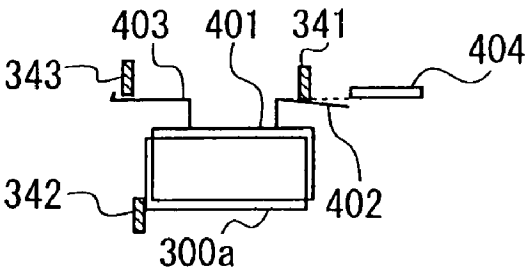
Figure 17C:
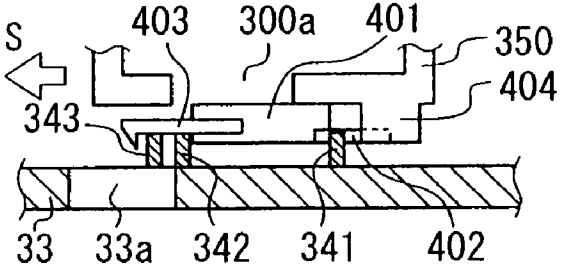
FIG. 17C is a view for illustrating how the shutter opening and closing mechanism of the toner container of the same embodiment operates when the toner container is slid to open the shutter element after disengagement of the anti-slide function.
Figure 17C:
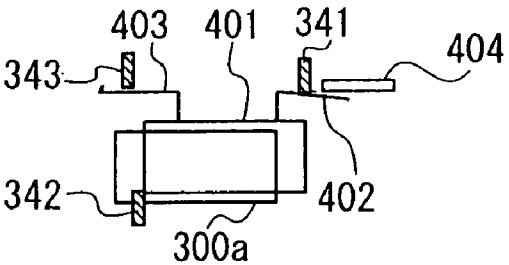
Figure 18A:
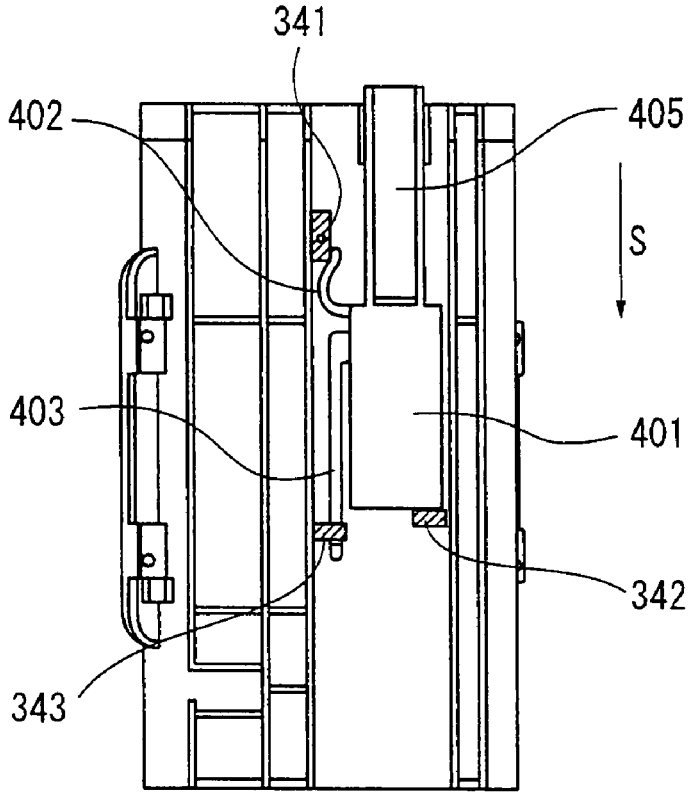
FIG. 18A is a plan view showing the first supporting member, viewed from the bottom side when the toner container of the same embodiment is set on the intermediate hopper and starts to be slid in the S-direction after disengagement of the anti-slide function.
Figure 18B:
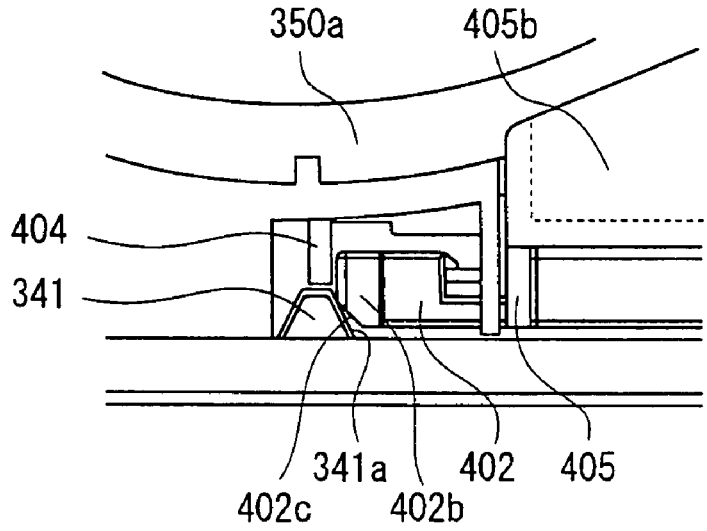
FIG. 18B is a side view showing the vicinity of a hook of the first supporting member when the toner container of the same embodiment is set on the intermediate hopper and is being slid in the S-direction after disengagement of the anti-slide function.
Figure 19A:
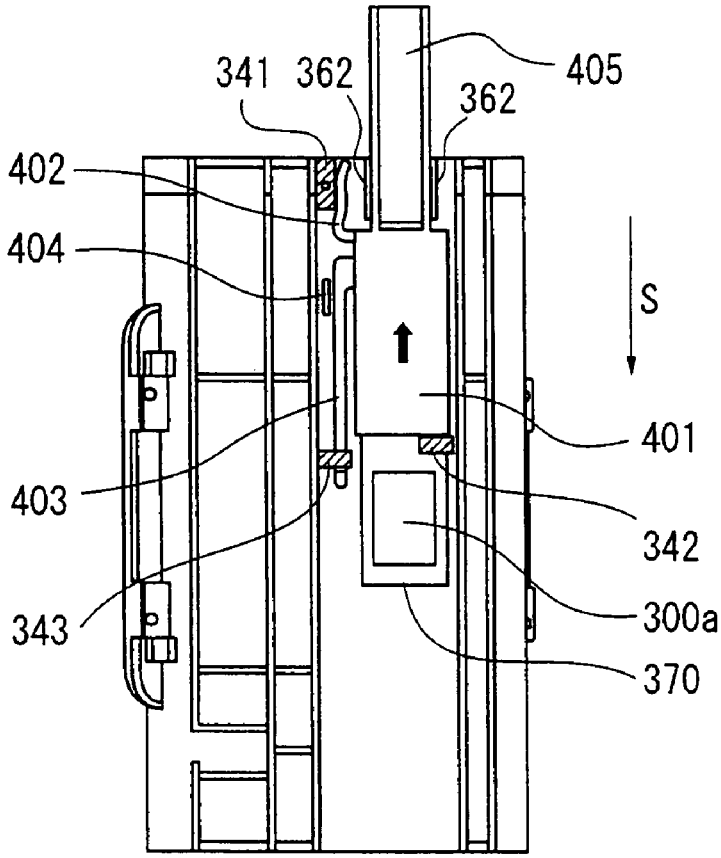
FIG. 19A is a plan view showing the first supporting member, viewed from the bottom side when the toner container of the same embodiment is set on the intermediate hopper and slid in the S-direction to open the shutter element after disengagement of the anti-slide function.
Figure 19B:
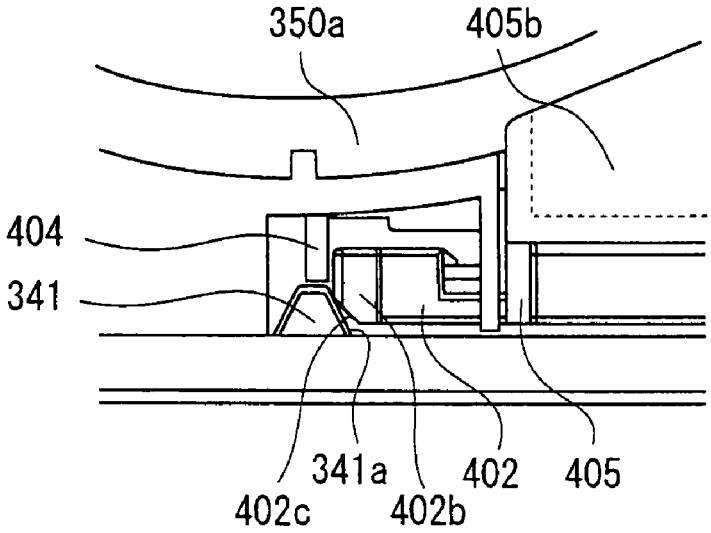
FIG. 19B is a side view showing the vicinity of the hook of the first supporting member when the toner container of the same embodiment is set on the intermediate hopper and is slid in the S-direction to open the shutter element after disengagement of the anti-slide function; and, FIG. 20A is a view showing how the shutter opening and closing mechanism of the toner container of the same embodiment operates when the shutter element starts to close.
Figure 20A:
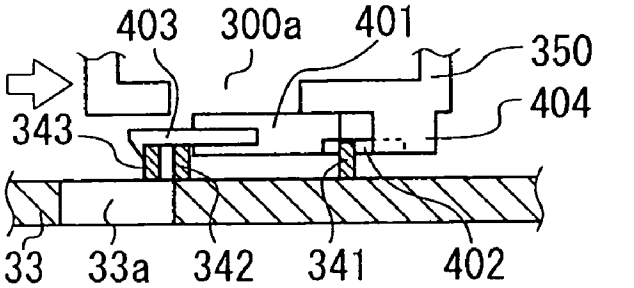
FIG. 20B is a view showing how the shutter opening and closing mechanism of the toner container of the same embodiment operates while the shutter element is being closed.
FIG. 20C is a view showing how the shutter opening and closing mechanism of the toner container of the same embodiment operates when the shutter element has been closed.
Figure 20A:
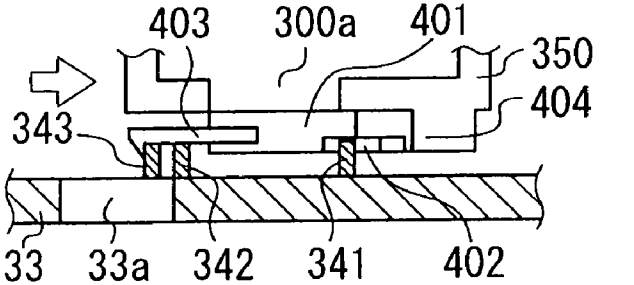
Figure 20A:
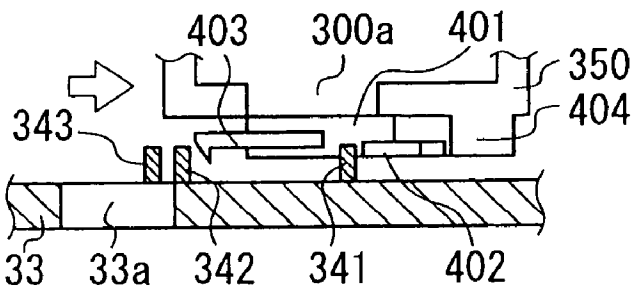
Figure 20A:
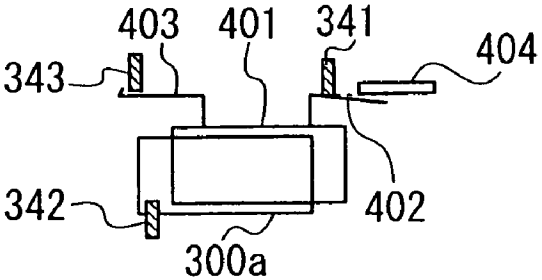
Figure 20B:
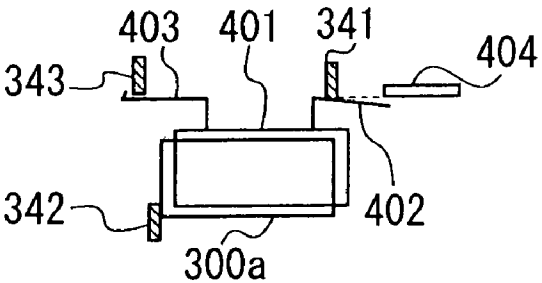
Figure 20C:
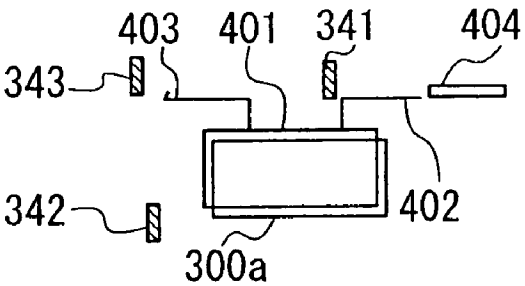

Next, the releasing operation of shutter opening and closing mechanism 400 provided for toner container 300 in the present embodiment will be described with reference to the drawings. FIG. 17A is a view for illustrating how the shutter opening and closing mechanism of toner container 300 of the present embodiment operates before disengagement of its anti-slide function, FIG. 17B is a view for illustrating how shutter opening and closing mechanism 400 of toner container 300 of the embodiment operates after disengagement of the anti-slide function, and FIG. 17C is a view for illustrating how shutter opening and closing mechanism 400 of toner container 300 of the embodiment operates when the toner container is slid to open shutter element 401 after disengagement of the anti-slide function. FIG. 18A is a plan view showing first supporting member 350*a*, viewed from the bottom side when toner container 300 of the embodiment is set on intermediate hopper 33 and starts to be slid in the S-direction after disengagement of the anti-slide function, and FIG. 18B is a side view showing the vicinity of the hook of first supporting member 350*a* when toner container 300 of the embodiment is set on intermediate hopper 33 and is being slid in the S-direction after disengagement of the anti-slide function. FIG. 19A is a plan view showing first supporting member 350*a*, viewed from the bottom side when toner container 300 of the embodiment is set on intermediate hopper 33 and slid in the S-direction to open shutter element 401 after disengagement of the anti-slide function, and FIG. 19B is a side view showing the vicinity of the hook of first supporting member 350*a* when toner container 300 of the embodiment is set on intermediate hopper 33 and is slid in the S-direction to open shutter element 401 after disengagement of the anti-slide function. FIG. 20A is a view showing how shutter opening and closing mechanism 400 of toner container 300 of the embodiment operates when shutter element 401 starts to close, FIG. 20B is a view showing how shutter opening and closing mechanism 400 of toner container 300 of the embodiment operates while shutter element 401 is being closed, and FIG. 20C is a view showing how shutter opening and closing mechanism 400 of toner container 300 of the embodiment operates when shutter element 401 has been closed. Here, in FIGS. 17 and 20, the drawings on the left side are schematic plan views, viewed from the toner container mount surface 340 side, for illustrating the positional relationship of shutter element 401, first and second regulating members 402 and 403, toner feed aperture 300*a*, shutter block 341 and first and second engaging projections 342 and 343 to explain how shutter opening and closing mechanism 400 of the present embodiment operates. The drawings on the right side in FIGS. 17 and 20 are schematic partial sectional views for illustrating the positional relationship of shutter element 401, first and second regulating members 402 and 403, toner feed aperture 300*a*, shutter block 341 and first and second engaging projections 342 and 343 to explain how shutter opening and closing mechanism 400 of the present embodiment operates.

The operation of releasing shutter element 401 by disengaging the anti-slide function of shutter opening and closing mechanism 400 of the present embodiment will be described first. As shown in FIG. 17A, toner container 300 (FIG. 5) is mounted on toner container mount surface 340 (FIG. 16) of intermediate hopper 33 (FIG. 16). At this point, anti-slide rib 404 does not abut hook 402*b* (FIG. 15A) of first regulating member 402, so that the function of first regulating member 402 and anti-slide rib 404 for preventing shutter element 401 from sliding has not been disengaged by shutter block 341.

Next, as shown in FIG. 17B, as toner container 300 is slid in the S-direction, shutter block 341 provided for toner container mount surface 340 abuts hook 402*b* (FIG. 15A) of first regulating member 402. As a result, shutter block 341 slides first regulating member 402 to the interior side so that hook 402*b* of first regulating member 402 becomes disengaged from anti-slide rib 404. That is, the anti-slide function by first regulating member 402 and anti-slide rib 404 is disengaged. In this action, since the portion where hook 402*b* of first regulating member 402 abuts shutter block 341 is formed as an inclined surface 402*c* as shown in FIG. 18B, hook 402*b* can be easily deflected to the interior side of anti-slide rib 404 by the inclined surface portion, designated at 341*a*, of shutter block 341. Here, in a configuration where hook 402*b* of first regulating member 402 abuts shutter block 341 when toner container 300 is set on toner container mount surface 340, the anti-slide function between first regulating member 402 and anti-slide rib 404 is disengaged at that timing.

As toner container 300 is slid in the S-direction after the above anti-slide function has been released, first engaging projection 342 abuts the end part of shutter element 401 to open shutter element 401 with the movement of toner container 300 (supporting structure 350) in the S-direction as shown in FIG. 17C, so that toner feed aperture 300*a* communicates with opening 33*a* of intermediate hopper 33. That is, in the present embodiment, upon mounting toner container 300 to intermediate hopper 33 of toner feed device 30, toner feed aperture 300*a* is adapted to open by releasing restriction on the movement of shutter element 401 by the anti-slide portion in linkage with this mounting action. Here in the present embodiment, when shutter element 401 is moved by sliding toner container 300 in the S-direction to the position where toner feed aperture 300*a* is completely open, the movement of shutter element 401 in the S-direction is limited by erected portions 362 as shown in FIG. 19A.

Next, the operation of closing shutter element 401 of shutter opening and closing mechanism 400 of the present embodiment will be described. When toner container 300 (FIG. 5) is dismounted from intermediate hopper 33 of toner feed device 30 at such an occasion as replacement of toner container 300 or the like, toner container 300 is slid in the direction opposite to the S-direction (FIG. 17), first, as shown in FIG. 20A. At this moment, hook 403*b* (FIG. 15) of second regulating element 403 is engaged by second engaging projection 343, and shutter element 401 is moved by second regulating member 403 in its closing direction (in the S-direction) as shown in FIG. 20B so that shutter element 401 closes toner feed aperture 300*a*. That is, when toner container 300 is dismounted from intermediate hopper 33 of toner feed device 30, shutter element 401 is moved in linkage with the dismounted operation to close toner feed aperture 300*a*.

Thereafter, shutter element 401 of shutter opening and closing mechanism 400 completely shuts up toner feed aperture 300*a*. As toner container 300 (supporting structure 350) is further slid, second regulating member 403 is elastically deformed upwards by the urging of the sliding movement so that hook 403*b* of second regulating member 403 disengages from second engaging projection 343. As a result, when toner container 300 is removed from intermediate hopper 33, shutter element 401 provided for shutter opening and closing mechanism 400 of toner container 300 is completely closed so that it is possible to prevent a little amount of toner remaining in toner container 300 from leaking out from toner feed aperture 300.

As has been described heretofore, provision of the anti-slide function of shutter element 401 of shutter opening and closing mechanism 400 provided for toner container 300 of the present embodiment makes it possible to prevent shutter element 401 from sliding to open before toner container 300 is mounted to intermediate hopper 33 of toner feed device 30 and makes it possible to prevent shutter element 401 of shutter opening and closing mechanism 400 for toner feed aperture 300*a* from being opened by unexpected load or the like.

Further, shutter opening and closing mechanism 400 of the present embodiment is constructed such that when toner container 300 is mounted to intermediate hopper 33 of toner feed device 30, the constraint on the movement of shutter element 401 by anti-slide portion is released in linkage with the mounting operation so as to open toner feed aperture 300*a*. On the other hand, when toner container 300 is dismounted from intermediate hopper 33 of toner feed device 30, toner feed aperture 300*a* is closed by the movement of shutter element 401 in linkage with the dismounting operation. As a result, it is possible to secure the opening and closing function of shutter opening and closing mechanism 400 with a simple configuration and in addition, improve the reliability of the opening and closing function of shutter element 401 of shutter opening and closing mechanism 400.

Though the above description was made taking a form of a preferred embodiment with reference to the accompanying drawings, it goes without saying that the technology should not be limited to this example. It is apparent that various modifications and variations will occur to those skilled in the art without departing from the spirit or scope of the following claims, and those should be considered to be within the technical scope of the technology.

For example, in the above first embodiment, the technology is applied to the toner container to be mounted to a monochrome image forming apparatus. However, the shutter opening and closing mechanism can be also applied to the toner containers for a color image forming apparatus.

What is claimed is:

1. A toner container that is removably attached to a toner feed device for feeding toner to a developing unit provided for an image forming apparatus, comprising:

a container body including a toner storing portion filled with toner, and a toner discharge aperture arranged in a toner feed recess formed on the outer peripheral surface of the toner storing portion for discharging toner from the toner storing portion by rotationally driving the toner storing portion about the axis thereof as a rotary axis; and a supporting structure, which supports the container body in a rotatable manner by enclosing the outer peripheral surface along the rotational direction of the container body so as to include the area where the toner feed recess is formed, and has a toner feed aperture for feeding the toner discharged from the toner discharge aperture into the toner feed recess, to the outside, characterized in that the supporting structure includes a shutter opening and closing mechanism comprising:

an approximately plate-like shutter element that is movable along a fixed direction to open and close the toner feed aperture;

a first regulating member on a side of the shutter element, the first regulating member extending toward an opening direction of the shutter element;

a second regulating member on a side of the shutter element, the second regulating member extending towards a closing direction of the shutter element;

an anti-slide rib for restraining the movement of the shutter element by abutting the first regulating member before the toner container is mounted to the toner feed device, the anti-slide rib projecting downward from a bottom surface of the supporting structure; and wherein as the toner container is inserted in a mounting direction onto a toner feed device, a shutter block on the toner feed device causes the first regulating member to deform, thereby releasing a constraint on movement of the shutter element, and wherein the second regulating member elastically deforms such that a hook of the second regulating member rides over an end of an engaging projection on the toner feed device, and wherein when the toner container is removed from the toner feed device, the hook catches on the engaging projection to pull the shutter closed as the toner container is removed.

2. The toner container according to claim 1, wherein an erected portion that stands upright to the surface where the shutter opening and closing mechanism is mounted in the supporting structure is formed between the outer part of the supporting structure and the anti-slide portion.

3. The toner container according to claim 1, wherein the container body is applied with a sealing element for sealing the toner discharge aperture; and the sealing element is engaged with the supporting structure at one end opposite to the other end thereof which seals the toner discharge aperture when the container body is held by the supporting structure.

* * * * *